US006624728B2

(12) United States Patent
Miyazaki et al.

(10) Patent No.: US 6,624,728 B2
(45) Date of Patent: Sep. 23, 2003

(54) LOW-PASS FILTER

(75) Inventors: Moriyasu Miyazaki, Tokyo (JP); Naofumi Yoneda, Tokyo (JP); Tetsu Ohwada, Tokyo (JP); Hiromasa Nakaguro, Tokyo (JP); Shiroh Kitao, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/936,821

(22) PCT Filed: Jan. 24, 2001

(86) PCT No.: PCT/JP01/00454

§ 371 (c)(1),
(2), (4) Date: Sep. 18, 2001

(87) PCT Pub. No.: WO01/57948

PCT Pub. Date: Aug. 9, 2001

(65) Prior Publication Data

US 2002/0163405 A1 Nov. 7, 2002

(30) Foreign Application Priority Data

Jan. 31, 2000 (JP) ..... 2000-021694

(51) Int. Cl.[7] ..... H01P 1/203
(52) U.S. Cl. ..... 333/204; 333/185
(58) Field of Search ..... 333/202, 204, 333/167, 168, 185, 245

(56) References Cited

U.S. PATENT DOCUMENTS

| | | | | |
|---|---|---|---|---|
| 2,922,968 A | * | 1/1960 | Van Patten | 333/204 |
| 5,461,352 A | * | 10/1995 | Noguchi et al. | 333/204 |
| 6,191,666 B1 | * | 2/2001 | Sheen | 333/185 |

FOREIGN PATENT DOCUMENTS

| | | | |
|---|---|---|---|
| JP | 0126301 A | * | 7/1984 |
| JP | A 59-212001 | | 11/1984 |
| JP | A62196902 | | 8/1987 |
| JP | A62241401 | | 10/1987 |
| JP | 0058901 A | * | 2/1990 |
| JP | 03071702 A | * | 3/1991 |
| JP | A 3-128501 | | 5/1991 |
| JP | 05218705 A | * | 8/1993 |
| JP | A 9-232805 | | 9/1997 |
| JP | 10065402 A | * | 3/1998 |
| JP | A2000183603 | | 6/2000 |

OTHER PUBLICATIONS

Miyazaki et al., "A Ka–Band LTCC High–Isolation Low-pass Filter with Attenuation Ples near the Passband", p. 154 Mar. 7, 2000.

* cited by examiner

*Primary Examiner*—Seungsook Ham
(74) *Attorney, Agent, or Firm*—Birch, Stewart, Kolasch & Birch, LLP

(57) ABSTRACT

It is an object of the present invention to realize a low-pass filter that has an increased number of stages of filter elements and can obtain a large combined capacitance with a simple configuration of a plane circuit, can set an attenuation pole in the vicinity of a pass band and has a steep out-of band attenuation characteristic. In order to attain such an object, three or more top end open stubs, which are set to have a large electric length in a range in which a length of is shorter than ¼ of a wavelength of a pass frequency, are disposed substantially in parallel so that their respective open ends face an identical direction to thereby form a combined line, and a high impedance line that is shorter than the wavelength of the pass frequency is connected to at least one part among parts between neighboring ends on the opposite side of open ends of the top end open stubs.

15 Claims, 20 Drawing Sheets

≅

$$\omega Cp_2 \simeq \frac{Yoa-Yea}{2} \tan\theta|_{\theta<\frac{\pi}{2}}$$

$$\omega C_2 \simeq Yea \tan\theta|_{\theta<\frac{\pi}{2}}$$

$$\omega C_3 \simeq Yeb \tan\theta|_{\theta<\frac{\pi}{2}}$$

≅

$$\omega Cp_2 \simeq -\frac{Yoa-Yea}{2}\cot\theta \,\Big|\, \frac{\pi}{2}<\theta<\pi$$

$$\omega C_2 \simeq -Yea\ \cot\theta \,\Big|\, \frac{\pi}{2}<\theta<\pi$$

$$\omega C_3 \simeq -Yeb\ \cot\theta \,\Big|\, \frac{\pi}{2}<\theta<\pi$$

LOW-PASS FILTER

This application is the national phase under 35 U.S.C. §371 of PCT International Application No. PCT/JP01/00454 which has an International filing date of Jan. 24, 2001, which designated the United States of America.

TECHNICAL FIELD

The present invention mainly relates to a low-pass filter that is used in VHF, UHF, microwave and milliwave bands.

BACKGROUND ART

FIGS. 18A and 18B are schematic views illustrating a configuration of a conventional low-pass filter described in, for example, Japanese Patent Application Laid-open No. Hei 3-128501. In FIGS. 18A and 18B, reference numeral 1 denotes an external conductor formed in a housing shape of a rectangular parallelepiped; 2 denotes a dielectric substrate provided in such a manner that it partitions inside of the external conductor 1 into two at its center; and 3 denotes foil-like internal conductors formed by etching in a pattern zigzagged opposing both sides of the dielectric substrate 2, each of which is composed of a plurality of wide parts 3*a* and narrow parts 3*b* and 3*c*.

Four wide parts 3*a* are disposed adjacent with each other and on a substantially straight line. Three narrow parts 3*b* are provided to electrically connect the wide parts 3*a* in series and are respectively bent at a right angle at two points. In addition, the narrow parts 3*c* are led out from the wide parts 3*a* at the both ends.

Reference numeral 4 denotes dielectric rods interposed between the narrow parts 3*a* on both sides of the dielectric substrate 2 and the internal surface of the external conductor 1. Reference numerals 5 and 6 denote coaxial input and output terminals provided in the external conductor 1, each central conductor of which is connected to the wide parts 3*c*. Reference numeral 7 denotes high impedance lines consisting of the narrow parts 3*b* and 3*c* and the external conductor 1. Reference numeral 8 denotes low impedance lines consisting of the wide parts 3*a*, the external conductor 1 and the dielectric rods 4.

Operations of the low-pass filter shown in FIGS. 18A and 18B will now be described with reference to its equivalent circuit diagram shown in FIG. 19. In FIG. 19, reference characters L1 to L3 denote inductors, which correspond to the high impedance line 7 and whose induction is determined according to line widths of the narrow parts 3*b* and 3*c*. Reference characters C1 and C2 denote capacitors, which correspond to the low impedance line 8 and whose capacitance is determined according to a line width of the wide parts 3*a* and a dielectric constant of the dielectric rods 4.

Here, the high impedance lines 7 and the low impedance lines 8 are required to perform pseudo-functions as an inductor and a capacitor of a lumped-constant circuit, respectively, and the respective axial lengths are set sufficiently smaller than a wave length of a pass-band frequency. In addition, reference characters Cp2 and Cp3 denote capacitors for giving an attenuation pole to a passing characteristic, which correspond to a combined capacity between adjacent low impedance lines 8 and whose capacitance is determined according to a distance between adjacent wide parts 3*a*.

As described above, the conventional configuration shown in FIGS. 18A and 18B is represented by the equivalent circuit shown in FIG. 19, and therefore has a function as a low-pass filter.

Moreover, an inductor Li (i=1, 2, 3, . . . ) and a capacitor Cpi form a parallel resonance circuit with a resonance frequency of f0

$$f_0 = \frac{1}{2}\sqrt{L_i C_{pi}}$$

Thus, if values of Li and Cpi are set such that this parallel resonance circuit operates to have necessary inductance as a whole at a frequency of a pass-band f0 a filter and generates parallel resonance at a frequency higher than the pass-band, that is, a stopping band frequency f0, the passing characteristic of this filer becomes a low-pass characteristic having an attenuation pole in the resonance frequency f0 as shown in FIG. 20. Therefore, a low-pass filter having a steep out-of band attenuation characteristic is obtained by placing this resonance frequency f0 at an appropriate position of the stopping band.

Since the conventional low-pass filter is composed as described above, a length of a section combining the adjacent low impedance lines 8 is relatively short and, in particular, if a line is formed with a uniform medium such as a triplet line, the coupling of the adjacent low impedance lines 8 cannot always be sufficient. Thus, there is a problem in that a large value cannot be obtained as capacitance of the capacitor Cpi and it is difficult to set the attenuation pole frequency f0 as low as in the vicinity of the pass-band.

The present invention has been devised to solve the above and other problems, and it is an object of the present invention to provide a low-pass filter that can set an attenuation pole in the vicinity of a pass-band and has a steep out-of band attenuation characteristic even if the low-pass filter has a simple configuration of a plane circuit consisting of a line such as a triplet line and a microstrip line.

SUMMARY OF THE INVENTION

According to the present invention, there is provided a low-pass filter comprising: combined lines formed of three or more top end open stubs, which are set to have a large electric length in a range in which a length is shorter than ¼ of a wavelength of a pass frequency and disposed substantially in parallel in such a manner that an open end of each of the three or more top end open stubs faces an identical direction; and a high impedance line connected to at least one part among parts between neighboring ends that are on the opposite side of the open ends of the top end open stubs and having a length shorter than the wavelength of the pass frequency.

Also, the high impedance line is a first high impedance line, and the low-pass filter further comprises, in addition to the first high impedance line, at least one second high impedance line that is connected at one end to ends on the opposite side of open ends of top end open stubs among the both ends of the three or more top end open stubs and has a length shorter than the wavelength of the pass frequency.

Further, the low-pass filter further comprising a low impedance line that is connected to at least one the other end of the second high impedance line at one end and has a length shorter than the wavelength of the pass frequency.

Still further, a multi-stage filter is formed by cascading low-pass filters in a plurality of stages via a high impedance line.

Yet still further, the low-pass filter is formed of a triplet line.

Further, the low-pass filter is formed of a micro-strip line.

Furthermore, the low-pass filter is formed of a coplanar line.

According to another aspect of the present invention, there is provided a low-pass filter comprising: combined lines formed of three or more top end short-circuit stubs, which are set to have a large electric length in a range in which a length is longer than ¼ and shorter than ½ of a wavelength of a pass frequency, and disposed substantially in parallel in such a manner that each of short-circuit ends of the three or more top end short-circuit stubs faces an identical direction; and a high impedance line connected to at least one part between ends among parts between ends that are on the opposite side of the short-circuit ends of the top end short-circuit stubs and adjacent with each other and having a length shorter than the wavelength of the pass frequency.

Also, the low-pass filter is formed of a triplet line.

Further, the low-pass filter is formed of a micro-strip line.

Furthermore, the low-pass filter is formed of a coplanar line.

Still further, the low-pass filter has a first conductor layer, a second conductor layer and a third conductor layer, which are disposed with the second conductor layer being sandwiched between the first and the third layers, and a ground conductor formed on external surfaces of the first and the third conductor layers, and is composed of a multi-layer high frequency circuit in which a central conductor is formed on the front and the back of the second conductor layer, and has a strip conductor forming a central conductor of a top end open stub and a strip conductor forming a central conductor of a high impedance line that are formed separately on the front side and the back side of the second conductor layer.

Yet still further, the low-pass filter has a first conductor layer, a second conductor layer and a third conductor layer, which are disposed with the second conductor layer being sandwiched between the first and the third layers, and a ground conductor formed on external surfaces of the first and the third conductor layers, and is composed of a multi-layer high frequency circuit in which a central conductor is formed in the front and the back of the second conductor layer, and has a strip conductor forming a central conductor of a top end short-circuit stub and a strip conductor forming a central conductor of a high impedance line that are formed separately on the front side and the back side of the second conductor layer.

Furthermore, the low-pass filter has a first conductor layer, a second conductor layer and a third conductor layer, which are disposed with the second conductor layer being sandwiched between the first and the third layers, and a ground conductor formed on external surfaces of the first and the third conductor layers, and is composed of a multi-layer high frequency circuit in which a central conductor is formed in the front and the back of the second conductor layer, has each strip conductor forming a central conductor of three or more top end open stubs forming a combined line, to which a high impedance line that is shorter than the wavelength of the pass frequency is connected between ends on the opposite side of the open ends of the top end open stubs adjacent with each other, provided on the front and the back of the second dielectric layer with sides opposing each other, and each strip conductor forming a central conductor of the high impedance line is connected to each strip conductor of the top end open stubs to be provided on the front and the back of the second dielectric conductor layer and connected via a through-hole in the middle.

Finally, the combined lines are a pair of combined lines disposed substantially in parallel in such a manner that each open end of the three or more top end open stubs faces an identical direction, and are connected in parallel such that the ends on the opposite side of open ends of the top end open stubs in each of the pair of combined lines are opposed to each other to be connected, and the low-pass filter is provided with a high impedance line which is connected to at least one part among parts between neighboring ends on the opposite side of the open ends of the top end open stubs and is shorter than a wavelength of a pass frequency, and has a first conductor layer, a second conductor layer and a third conductor layer disposed with the second conductor layer being sandwiched between the first and the third conductor layers and ground conductors formed on the external surfaces of the first and the third conductor layers, and is composed of a multi-layer high frequency circuit in which a central conductor is formed on the front and the back side of the second dielectric layer, and has each strip conductor forming a central conductor of the top end open stubs formed on one side of the second dielectric conductor layer, and a strip conductor forming a central conductor of the high impedance line formed on the other side of the second dielectric layer, and in which the connection between ends on the opposite side of the open ends of the top end open stubs and the high impedance line is made by the connection via a through-hole of a strip conductor forming a central conductor formed on the front and the back side of the second dielectric layer.

DETAILED DESCRIPTION OF THE INVENTION

First Embodiment

Figure 1:
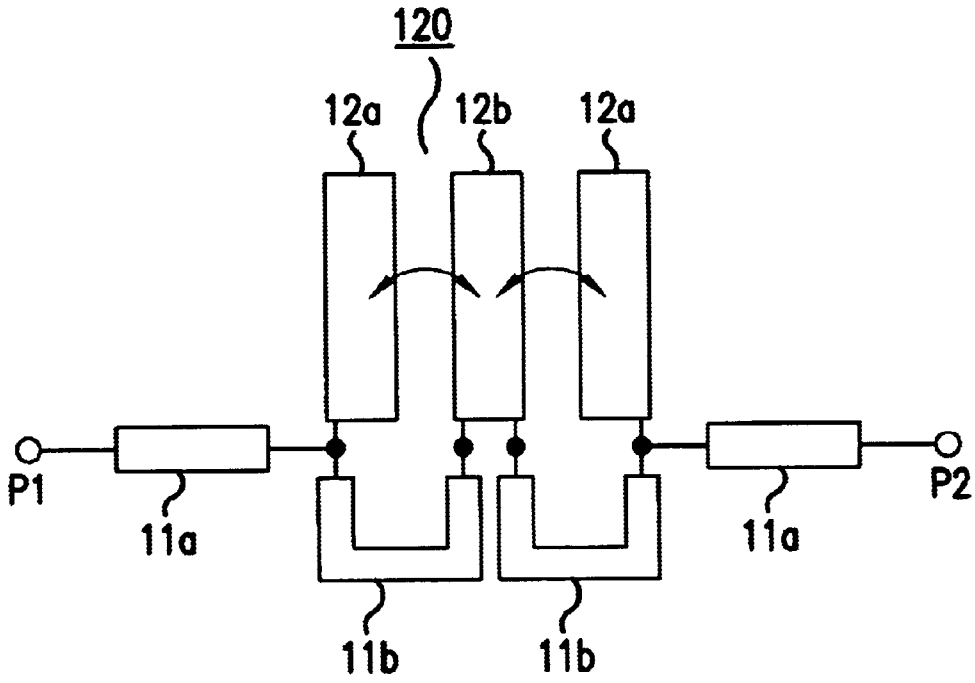
FIG. 1 is a schematic view illustrating a configuration of a low-pass filter in accordance with a first embodiment of the present invention.

FIG. 1 is a schematic view illustrating a configuration of a low-pass filter in accordance with a first embodiment of the present invention. In FIG. 1, reference character P1 denotes an input terminal, P2 denotes an output terminal; 11*a* denotes two high impedance lines (second high impedance lines), one ends of which are connected to the input terminal P1 and the output terminal P2; and 11*b* denotes two high impedance lines (first high impedance lines), one ends of which are connected to the other ends of the two high impedance lines 11, respectively. An axial length of each of the high impedance lines 11*a* and 11*b* is set sufficiently smaller than a wavelength of a pass frequency.

In addition, reference numerals 12*a* and 12*b* denote top end open stubs, and 120 denotes a combined line composed of three top end open stubs 12*a* and 12*b*. These three top end open stubs 12*a*, 12*b* and 12*a* are disposed substantially in parallel having the top end open stub 12*b* between the top end open stubs 12*a* in such a manner that these open ends face an identical direction. Ends on the opposite side of the open ends of each of the top end open stubs 12*a* and the top end open stub 12*b* are mutually connected via separate high impedance lines 11*b*, respectively. In addition, an electric length of each of these open end stubs 12*a* and 12*b* is set smaller than ¼ of the wavelength of the pass frequency.

Figure 2:
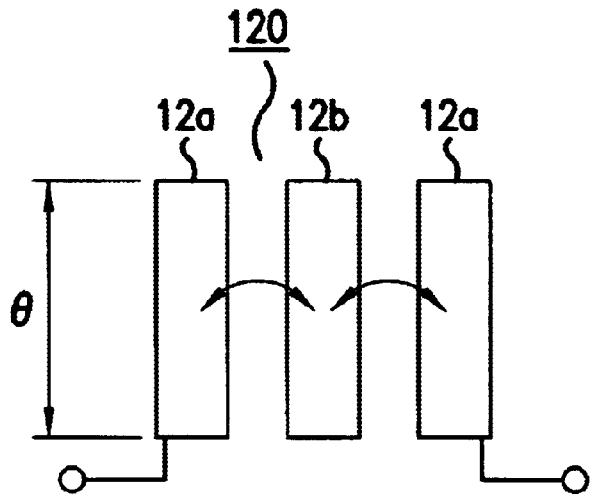
FIG. 2 is a schematic view illustrating a configuration of a combined line of the low-pass filter.
Figure 3A:
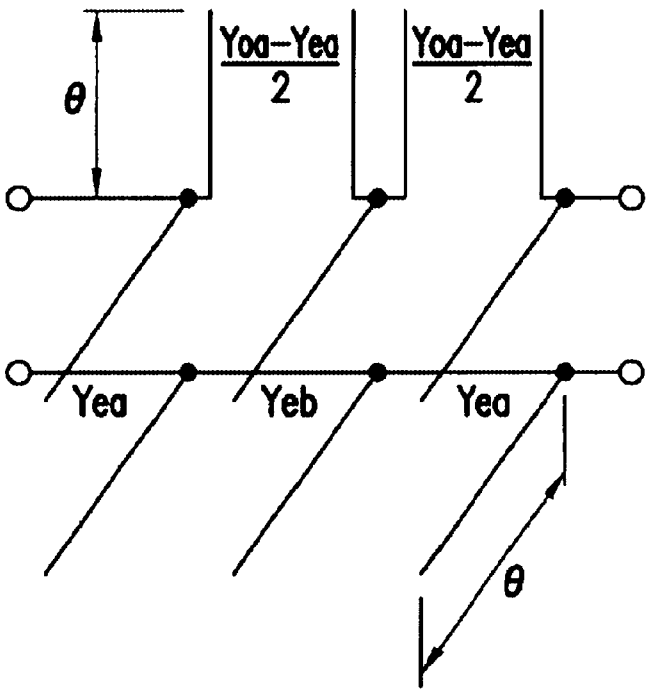
FIGS. 3A and 3B are equivalent circuit diagrams of the combined line.
Figure 3B:
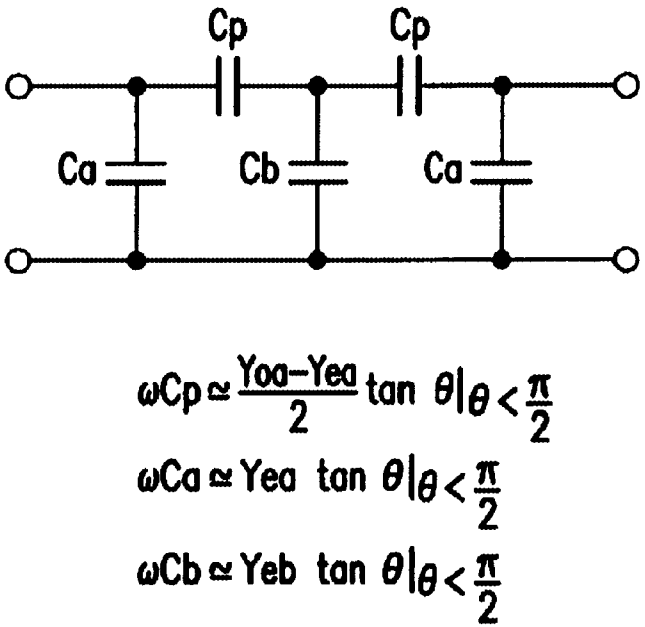

Operations will now be described. FIG. 2 is a schematic view illustrating a configuration of the combined line 120. In FIG. 2, reference character θ denotes an electric length of the top end open stubs 12*a* and 12*b*. In addition, FIGS. 3A and 3B are equivalent circuit diagrams of the combined line 120. In FIGS. 3A and 3B, reference characters Yea, Yeb and Yoa denote characteristic admittance of an even mode and an odd mode of the combined line 120.

Here, in an angular frequency ω satisfying $\theta<\pi/2$, a circuit shown in FIG. 3A can be approximately represented by an equivalent circuit of FIG. 3B. As can be seen from an expression shown in FIG. 3B, capacitance of series capacitor Cp changes according to a difference of characteristic admittance Yea and Yoa, that is, a combined capacitance between three top end open stubs 12*a* and 12*b* and the electric length θ of the top end open stubs 12*a* and 12*b*. Capacitance of parallel capacitors Ca and Cb changes according to characteristic admittance Yea and Yeb, that is, mainly to characteristic impedance of the even mode of the top end open stubs 12*a* and 12*b* and the electric length 6 of the top end open stubs 12*a* and 12*b*.

Therefore, in the combined line 120, a relatively large value can be obtained as the capacitance of the series capacitor Cp shown in FIG. 3B by adjusting the electric length θ of the top end open stubs 12*a* and 12*b* in the range of $0<\theta<\pi/2$.

Figure 4A:
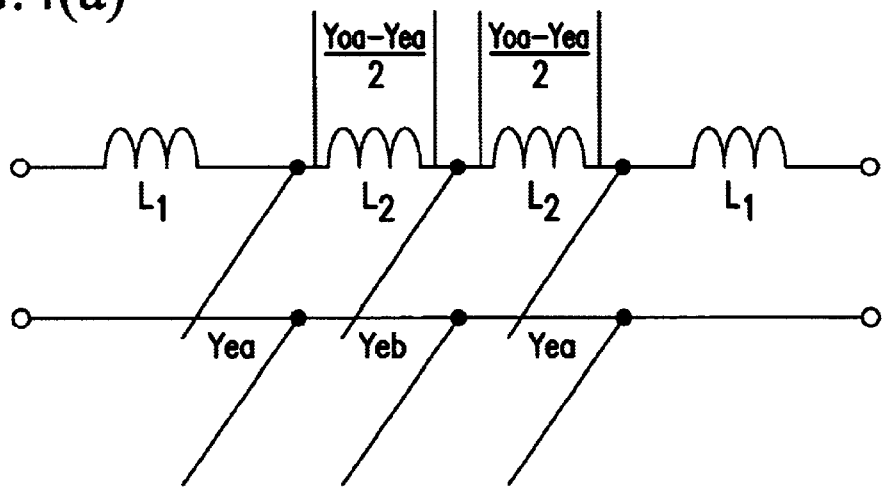
FIGS. 4A and 4B are equivalent circuit diagrams of the low-pass filter.
Figure 4B:
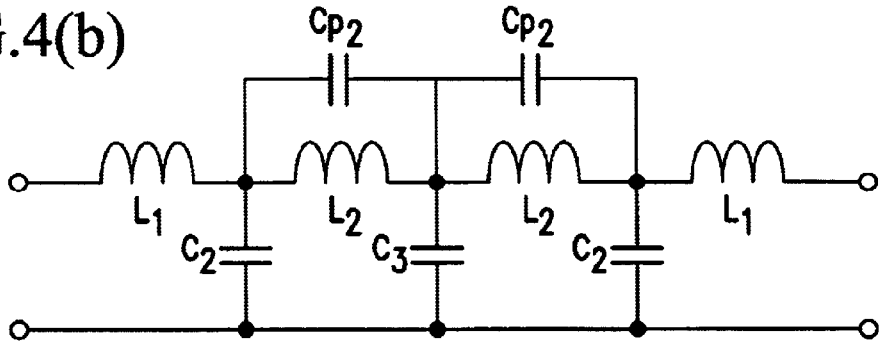
Figure 18A:
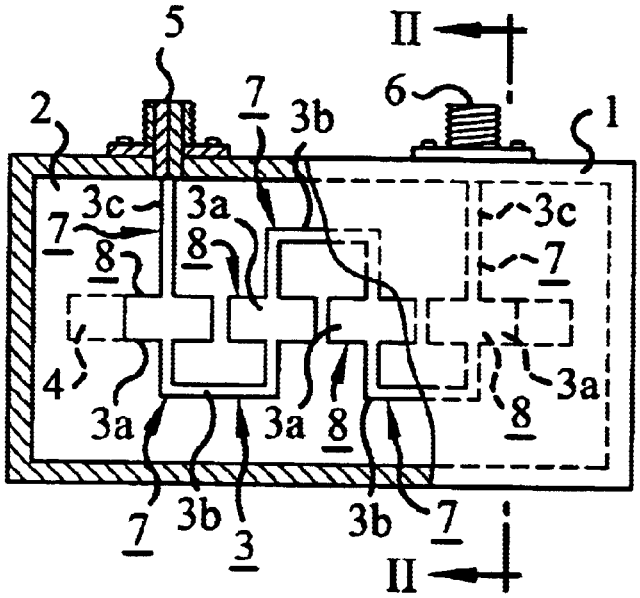
Fig.18(a) CONVENTIONAL ART
FIGS. 18A and 18B are schematic views illustrating a configuration of a conventional low-pass filter.
Figure 18B:
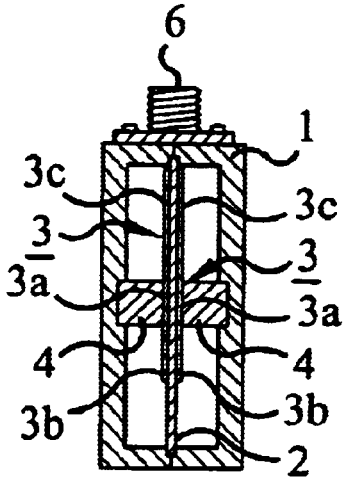
Fig.18(b) CONVENTIONAL ART
Figure 19:
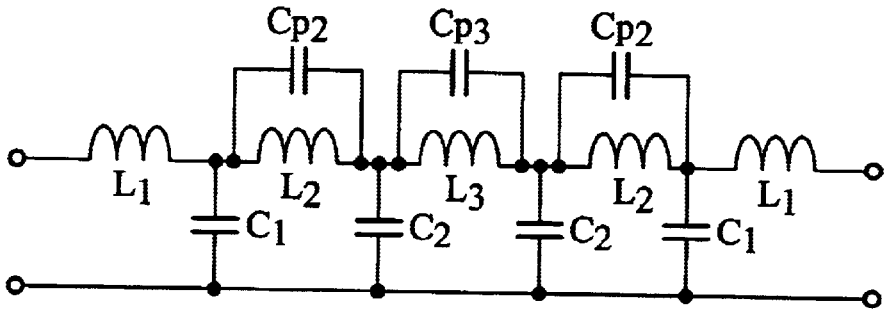
Fig.19 CONVENTIONAL ART
FIG. 19 is an equivalent circuit diagram showing the conventional low-pass filter.
Figure 20:
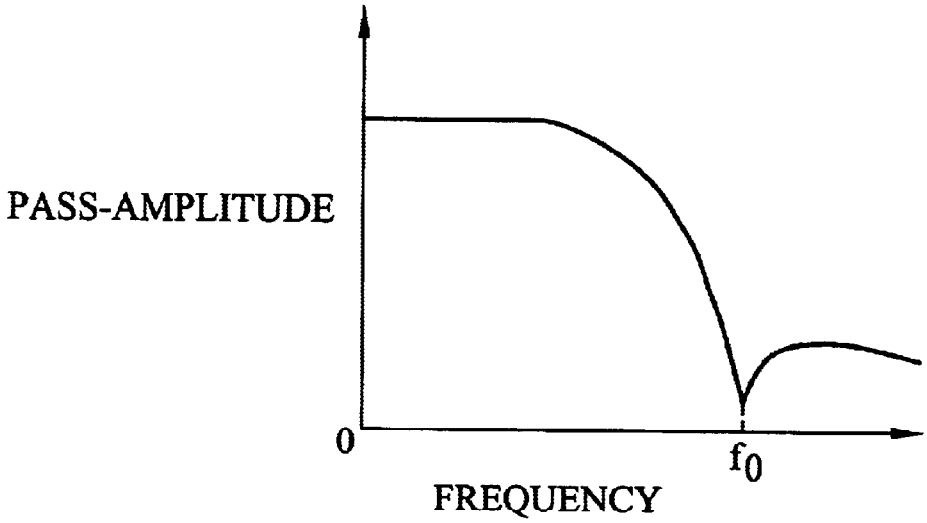
Fig.20 CONVENTIONAL ART
FIG. 20 is a graph showing passing characteristics of the conventional low-pass filter and the low-pass filter in accordance with the present invention.

FIGS. 4A and 4B are equivalent circuit diagrams of the above-mentioned low-pass filter. If the circuit shown in FIG. 3A is used as it is in an equivalent circuit of the low-pass filter shown in FIG. 1, the equivalent circuit can be represented by FIG. 4A. Here, reference character L1 denotes series inductors according to the high impedance lines 11*a*, and L2 denotes series inductors according to the high impedance lines 11*b*. Moreover, if a relation between FIG. 3A and FIG. 3B is applied to FIG. 4A, an equivalent circuit shown in FIG. 4B is eventually obtained with respect to the configuration of FIG. 1. Since the equivalent circuit of FIG. 4B includes a parallel resonance circuit consisting of the capacitors Cp2 and the inductors L2, the filter shown in FIG. 1 has a function of a low-pass filter having a polarized characteristic shown in FIG. 20 as in the conventional case shown in FIGS. 18A and 18B and FIG. 19.

Here, although the example of forming a combined line by three top end open stubs is indicated in the description of the first embodiment, the same can be similarly applied to a case with four or more top end open stubs.

In this way, a combined line is formed using three or more top end open stubs (this is the same in the case of a fifth embodiment forming a combined line by top end short-circuit stubs to be described later), whereby a number of stages of a filter element that becomes an element of a low-pass filter can be increased, and a low-pass filter having a favorable out-of band attenuation characteristic can be realized.

As described above, according to the first embodiment, the low-pass filter illustrated in FIG. 1 has a configuration including the combined line 120. Thus, there is an effect in that the capacitance of the capacitors Cp2 can be made larger than before by setting the electric length θ of the open end stub 12 large in the range of $0<\theta<\pi/2$ (within a range in which it is shorter than ¼ of a wavelength of a pass frequency) as mentioned in the description of FIG. 3B. Since the capacitance of the capacitor Cp2 can be made large, it is possible to set a frequency of an attenuation pole as low as in the vicinity of a passing band, therefore, a low-pass filter having a steep out-of band attenuation characteristic is obtained.

Further, in the first embodiment described above, the low-pass filter is composed of the two high impedance lines 11*a* and 11*a*, the two high impedance lines 11*b* and 11*b*, and the combined line 120 formed of the three top end open stubs 12*a*, 12*b* and 12*a* as shown in FIG. 1. However, the high impedance line 11*a* may not be provided or may be provided on only one side according to a desired out-of band attenuation characteristic. In addition, an attenuation pole can be formed if at least one high impedance line 11*b* is provided.

Moreover, the low-pass filter shown in FIG. 1 may be configured as a multi-stage filter by being cascaded in a plurality of stages via the high impedance lines 11*a* to have a desired out-of band attenuation characteristic. That is, a plurality of the low-pass filters may be cascaded by inserting at least one second high impedance line, which has a length shorter than a wavelength of a pass frequency, in series between combined lines of the low-pass filter connected one after another to form a multi-stage filter, thereby obtaining a desired out-of band attenuation characteristic.

In addition, although the case in which both the electric lengths of the top end open stub 12*a* and the top end open stub 12*b* are equal at θ is indicated in the description of the first embodiment, since sections of both stubs opposing each other function as a combined line even if electric lengths are different as indicated by θa and θb, an operational principle, an effect and an advantage similar to those in the first embodiment are realized. Moreover, since the sizes of the electric lengths θa and θb can be changed independently, there is an advantage in that a range in which the capacitance of the parallel capacitors Ca and Cb can be set is extended and a degree of freedom of design is increased.

Second Embodiment

Figure 5A:
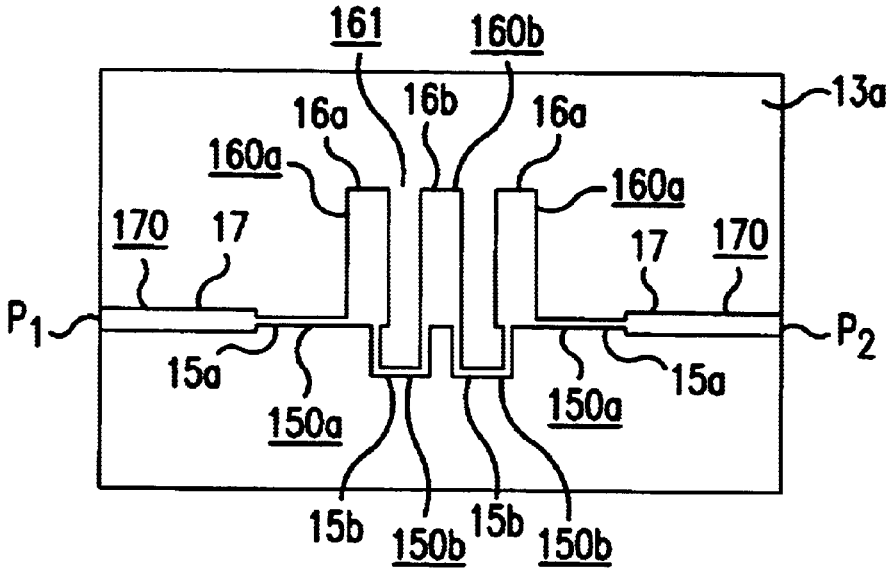
FIGS. 5A and 5B are schematic views illustrating a configuration of a low-pass filter formed of a triplet line in accordance with a second embodiment of the present invention.
Figure 5B:
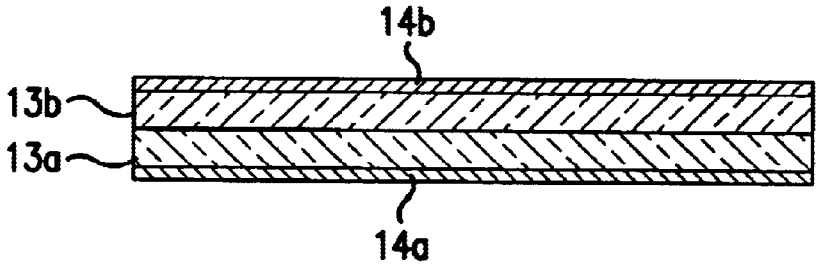

FIGS. 5A and 5B are schematic views illustrating a configuration of a low-pass filter formed of a triplet line in accordance with a second embodiment of the present invention. Here, the low-pass filter will be described according to an example in which the low-pass filter shown in FIG. 1 is formed of a triplet line. FIG. 5A is a top view showing an arrangement on a dielectric substrate 13*a* as compared with a sectional view shown in FIG. 5B.

In FIGS. 5A and 5B, reference numerals 13*a* and 13*b* denote dielectric substrates; 14*a* denotes a film-like external conductor that is formed in close adherence to one side of the dielectric substrate 13*a;* 14*b* denotes a film-like external conductor that is formed in close adherence to one side of the dielectric substrate 13*b;* 15*a* denotes narrow strip conductors that are formed in close adherence to the other side of the dielectric substrate 13*a;* 15*b* denotes narrow strip conductors that are formed in close adherence to the other side of the dielectric substrate 13*b;* 16*a* and 16*b* denote one end open strip conductors that are formed in close adherence to the other side of the dielectric substrate 13*a;* and 17 denotes strip conductors.

In addition, reference numeral 150*a* denotes high impedance lines (second high impedance lines) consisting of the dielectric substrates 13*a* and 13*b,* the external conductors 14*a* and 14*b* and the strip conductor 15*a;* 150*b* denotes high impedance lines (first high impedance line) consisting of the dielectric substrates 13*a* and 13*b,* the external conductors 14*a* and 14*b* and the strip conductor 15*b;* 160*a* and 160*b* denote top end open stubs consisting of the dielectric substrates 13*a* and 13*b,* the external conductors 14*a* and 14*b* and the respective strip conductors 16*a* and 16*b;* 161 denotes a combined line consisting of the three top end open stubs 160*a* and 160*b* that are arranged substantially in parallel in such a manner that opening ends thereof face an identical direction; 170 denotes input and output lines consisting of the dielectric substrates 13*a* and 13*b,* the external conductors 14*a* and 14*b* and the strip conductors 17; reference character P1 denotes an input terminal; and P2 denotes an output terminal.

Here, the dielectric substrate 13*a* and the dielectric substrate 13*b* are superimposed in such a manner that the side of the dielectric substrate 13*a* on which the strip conductors 15*a,* 15*b,* 16*a,* 16*b* and 17 are formed in close adherence and the side of the dielectric substrate 13*b* on which the external conductor 14*b* is not formed oppose each other. Thus, the high impedance lines 150*a,* the high impedance lines 150*b,* the combined lines 161 and the input and output lines 170 are composed of a triplet line.

Both axial lengths of the high impedance lines 150*a* and 150*b* are set sufficiently smaller than a wavelength of a pass frequency. The high impedance lines 150*b* are connected to parts between three adjacent ends, respectively, that are on the opposite side of respective opening ends of the combined line 161. The high impedance lines 150*a* are connected to a junction of the both ends of the combined line 161 and the high impedance lines 150*b* at its one end and to the input terminal P1 or the output terminal P2 at the other end. An equivalent circuit of the low-pass filter shown in FIGS. 5A and 5B is represented by FIG. 4B as in the case of FIG. 1.

As described above, according to this second embodiment, a low-pass filter is formed of a triplet line. Thus, since a conductor pattern can be formed on the dielectric substrate 13*a* by photo-etching or the like, an effect is realized in that a small low-pass filter with a high accuracy of dimensions and a stable characteristic can be obtained relatively easily in addition to the effect of the first embodiment.

Third Embodiment

Figure 6:
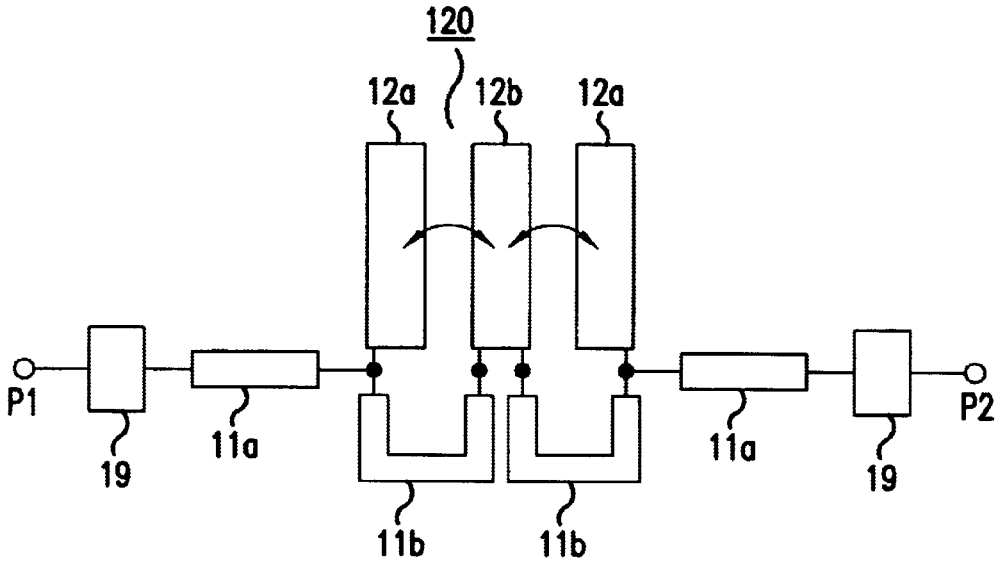
FIG. 6 is a schematic view illustrating a configuration of a low-pass filter in accordance with a third embodiment of the present invention.

FIG. 6 is a schematic view illustrating a configuration of a low-pass filter in accordance with the third embodiment of the present invention. In FIG. 6, reference numeral 19 denotes two low impedance lines connected between each ends of the high impedance lines 11*a* and the input terminal P1 and the output terminal P2, respectively. An axial length of the low impedance lines 19 is set sufficiently smaller than a wavelength of a pass frequency. The other configurations are identical with those in FIG. 1.

Figure 7:
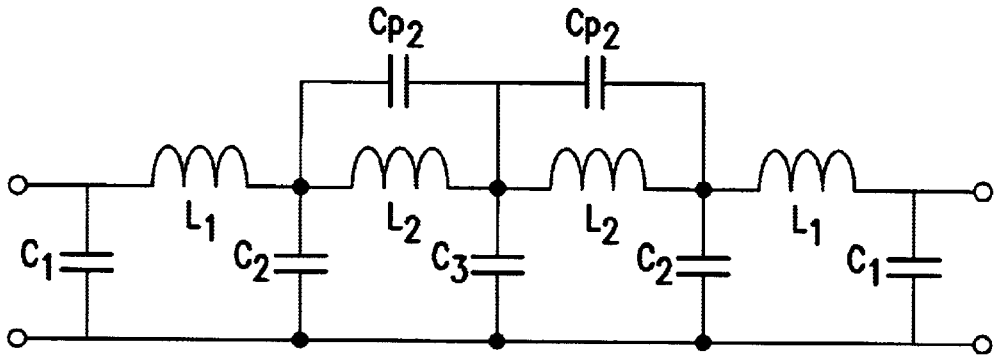
FIG. 7 is an equivalent circuit diagram of the low-pass filter.

In addition, FIG. 7 is an equivalent circuit diagram of the above-mentioned low-pass filter. In FIG. 7, reference character C1 denotes parallel capacitors corresponding to the low impedance lines 19, and the other configurations are identical with those in FIG. 4B.

As described above, according to this third embodiment, the parallel capacitor C1 corresponding to the low impedance line 19 is added. Thus, a number of stages as a low-pass filter (a number of stages of filter elements) is increased and an effect is realized in that a steeper out-of band attenuation characteristic is obtained in addition to the effect of the first embodiment.

Fourth Embodiment

Figure 8A:
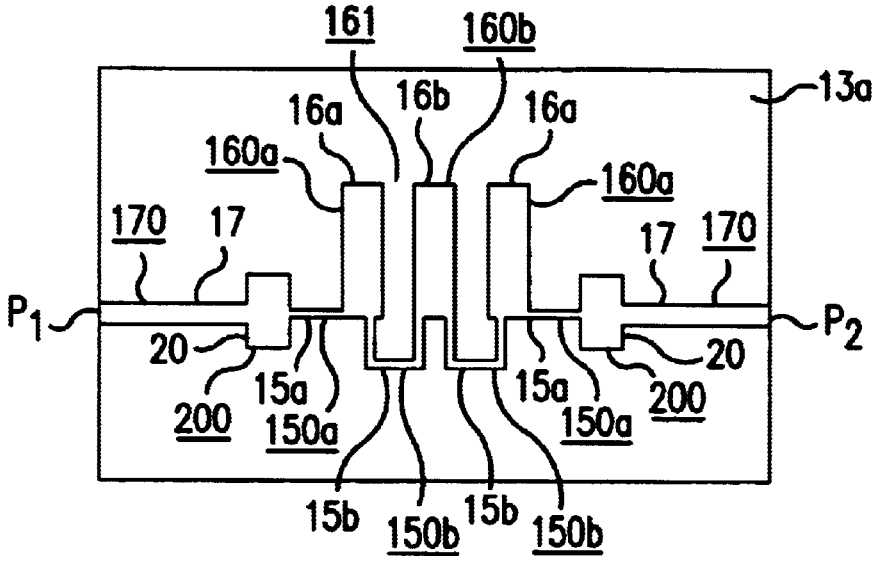
FIGS. 8A and 8B are schematic views illustrating a configuration of a low-pass filter formed of a triplet line in accordance with a fourth embodiment of the present invention.
Figure 8B:
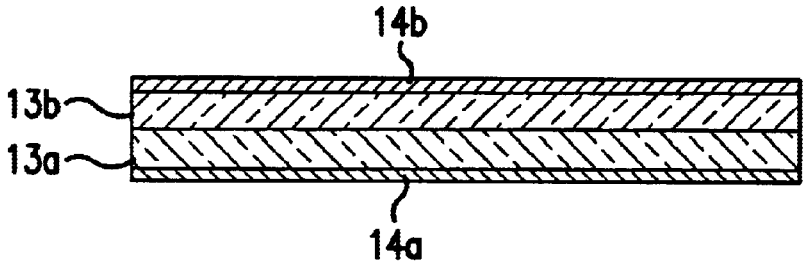

FIGS. 8A and 8B are schematic views illustrating a configuration of a low-pass filter formed of a triplet line in accordance with a fourth embodiment of the present invention. Here, the low-pass filter will be described according to an example in which the low-pass filter in accordance with the third embodiment shown in FIG. 6 is formed of a triplet line. FIG. 8A is a top view showing an arrangement on the dielectric substrate 13*a* as compared with a sectional view shown in FIG. 8B.

In FIGS. 8A and 8B, reference numeral 20 denotes wide strip conductors that are formed in close adherence to the other side of the dielectric substrate 13*a,* and 200 denotes low impedance lines consisting of the dielectric substrates 13*a* and 13*b,* the external conductors 14*a* and 14*b* and the strip conductors 20. As in the case of FIGS. 5A and 5B, the high impedance lines 150*a,* the high impedance lines 150*b,* the combined line 161, the input and output lines 170 and the low impedance lines 200 are composed of a triplet line.

All axial lengths of the high impedance lines 150*a,* the high impedance lines 150*b* and the low impedance lines 200 are set sufficiently smaller than a wave length of a pass frequency. Each of the two low impedance lines 200 is connected to the high impedance line 150*a* at one end and to the input terminal P1 or the output terminal P2 at the other end. An equivalent circuit of the low-pass filter shown in FIGS. 8A and 8B is represented by FIG. 7 as in the case of FIG. 6. The other configurations are identical with those in FIGS. 5A and 5B.

As described above, according to this fourth embodiment, a low-pass filter is formed of a triplet line. Thus, since a conductor pattern can be formed on the dielectric substrate 13*a* by photo-etching or the like, an effect is realized in that a small low-pass filter with a high accuracy of dimensions and a stable characteristic is obtained relatively easily in addition to the effect of the third embodiment.

Fifth Embodiment

Figure 9:
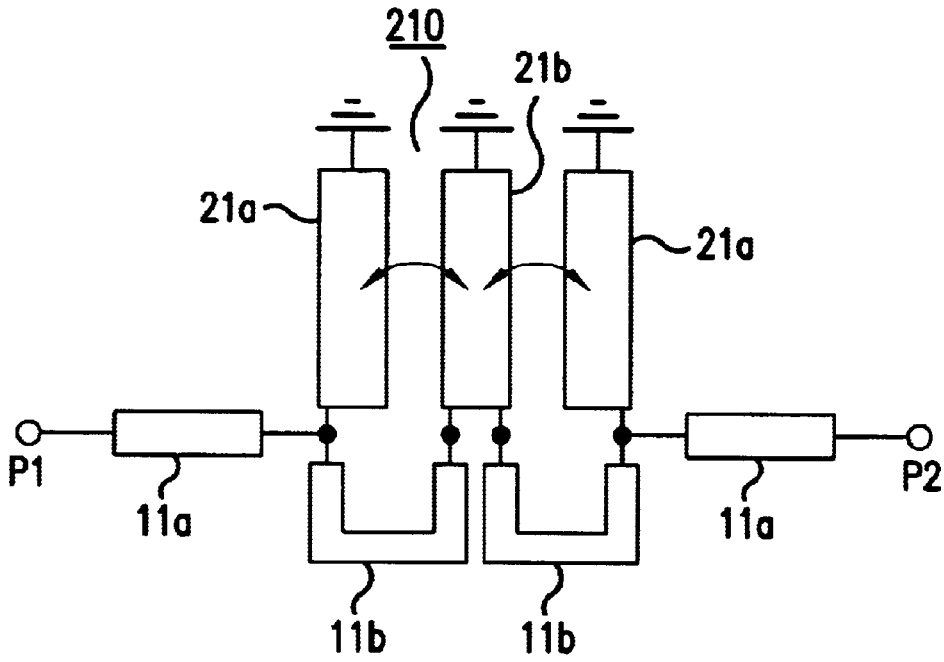
FIG. 9 is a schematic view illustrating a configuration of a low-pass filter in accordance with a fifth embodiment of the present invention.

FIG. 9 is a schematic view illustrating a configuration of a low-pass filter in accordance with a fifth embodiment of the present invention. In FIG. 9, reference numerals 21*a* and 21*b* denote top end short-circuit stubs, and 210 denotes a combined line composed of the three top end short-circuit stubs 21*a* and 21*b*. These three top end short-circuit stubs 21*a* and 21*b* are disposed substantially in parallel with the top end short-circuit stub 21*b* between the top end short-circuit stubs 21*a* in such a manner that these short-circuit ends face an identical direction. Ends on the opposite side of the short-circuit ends of each of the top end short-circuit stubs 21*a* and the top end short-circuit stub 21*b* are mutually connected via separate high impedance lines 11*b,* respectively. In addition, an electric length of each of these top end short-circuit stubs 12*a* and 12*b* is set larger than ¼ of a wavelength of a pass frequency and smaller than ½ of the wavelength. The other configurations are identical with those of FIG. 1.

Operations will now be described.

Figure 10:
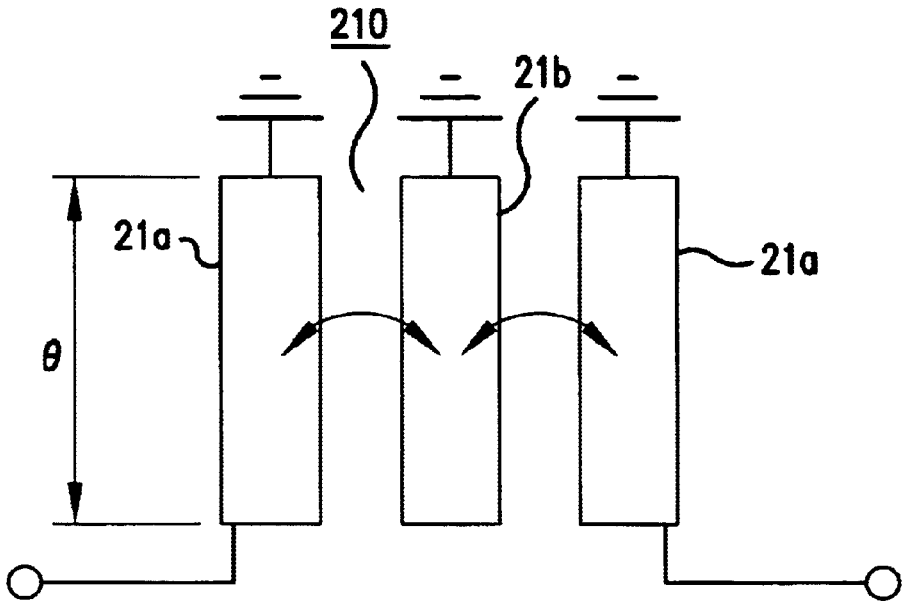
FIG. 10 is a schematic view illustrating a configuration of a combined line of the low-pass filter.
Figure 11B:
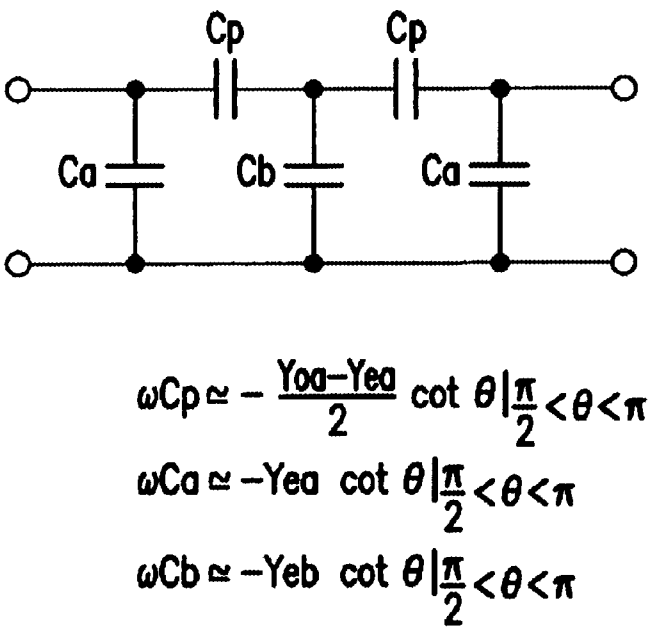
FIGS. 11A and 11B are equivalent circuit diagrams of the combined line.
Figure 11A:
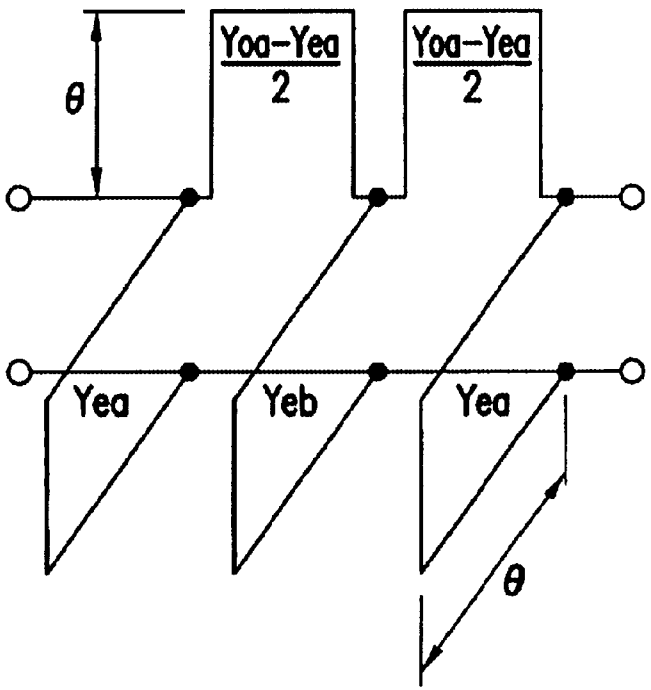

FIG. 10 is a schematic view illustrating a configuration of the combined line 210. In FIG. 10, reference character θ denotes an electric length of the top end short-circuit stubs 21*a* and 21*b*. In addition, FIGS. 11A and 11B are equivalent circuit diagrams of the combined line 210. In FIGS. 11A and 11B, reference characters Yea, Yeb and Yoa denote characteristic admittance of an even mode and an odd mode of the combined line 210.

Here, at an angular frequency ω satisfying $\pi/2<\theta<\pi$, a circuit shown in FIG. 11A can be approximately represented by an equivalent circuit shown in FIG. 11B. As can be seen from an expression of FIG. 11B, capacitance of series capacitors Cp changes according to a difference of characteristic admittance Yea and Yoa, that is, a combined capacity between the top end short-circuit stubs 21*a* and 21*b* and the electric length θ of the top end short-circuit stubs 21*a* and 21*b*. Capacitance of parallel capacitors Ca and Cb change according to characteristic admittance Yea and Yeb, that is, mainly to characteristic impedance of the top end short-circuit stubs 21*a* and 21*b* and the electric length θ of the top end short-circuit stubs 21*a* and 21*b*. That is, in the combined line 210, a relatively large value can be obtained as the capacitance of the series capacitors Cp shown in FIG. 11B by adjusting the electric length θ of the top end short-circuit stubs 21*a* and 21*b*.

Figure 12A:
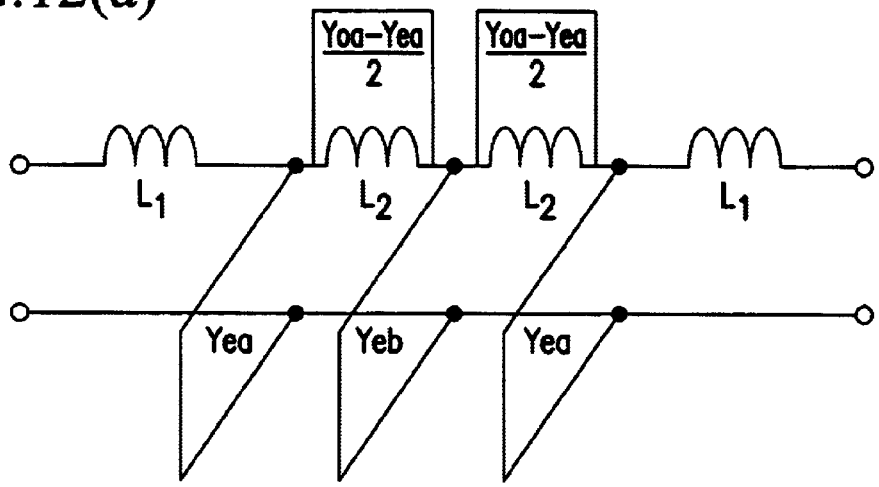
FIGS. 12A and 12B are equivalent circuit diagrams of the low-pass filter.
Figure 12B:
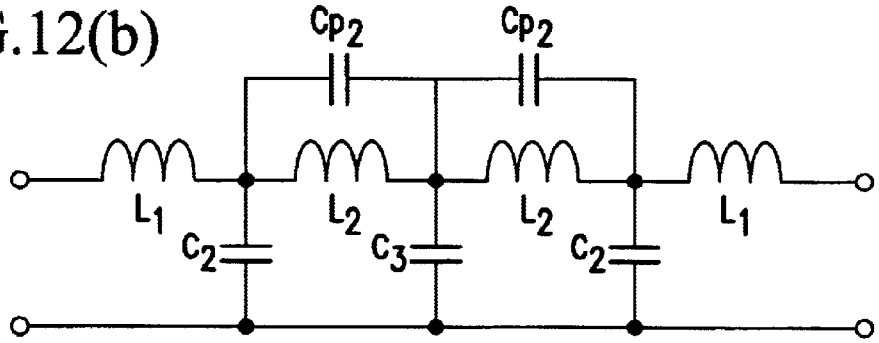

FIGS. 12A and 12B are equivalent circuit diagrams of the above-mentioned low-pass filter. If the circuit shown in FIG. 11A is used as it is in an equivalent circuit of the low-pass filter shown in FIG. 9, the equivalent circuit can be represented by FIG. 12A. Moreover, if a relation represented by an equation shown in FIGS. 11A and 11B is applied to FIG. 12A, an equivalent circuit shown in FIG. 12B is eventually obtained with respect to the configuration of FIG. 9. Since the equivalent circuit of FIG. 12B includes a parallel resonance circuit consisting of the capacitors Cp2 and the inductors L2, the filter shown in FIG. 9 has a function of a low-pass filter having a polarized characteristic shown in FIG. 20 as in the conventional case shown in FIGS. 18A and 18B and FIG. 19.

As described above, according to this fifth embodiment, the low-pass filter illustrated in FIG. 9 has a configuration including the combined line 210. Thus, there is an effect in that the capacitance of the capacitors Cp2 can be made larger than before by setting the electric length θ of the top end short-circuit stubs 21*a* and 21*b* large to be in the range of $\pi/2<\theta<\pi$ as mentioned in the description of FIG. 11B. By this effect that the capacitance of the capacitors Cp2 can be made large, it is possible to set a frequency of an attenuation pole as low as in the vicinity of a passing band, therefore, there is an effect in that a low-pass filter having a steep out-of band attenuation characteristic is obtained.

In addition, although the case in which both the electric lengths of the top end short-circuit stub 21*a* and 21*b* are equal at θ is indicated in the description of the fifth embodiment, in the case in which sections of both stubs opposing each other function as a combined line satisfying the conditions of the fifth embodiment, even if electric lengths are different as indicated by θa and θb, an operational principle, an effect and an advantage similar to those in the fifth embodiment are realized. Moreover, since the sizes of the electric lengths θa and θb can be changed independently, there is an advantage in that a range in which the capacitance of the parallel capacitors Ca and Cb can be set is extended and a degree of freedom of design is increased.

Moreover, the low-pass filter shown in FIG. 9 may be configured as a multi-stage filter by being cascaded in a plurality of stages via the high impedance lines 11*a* to have a desired out-of band attenuation characteristic.

Sixth Embodiment

Figure 13A:
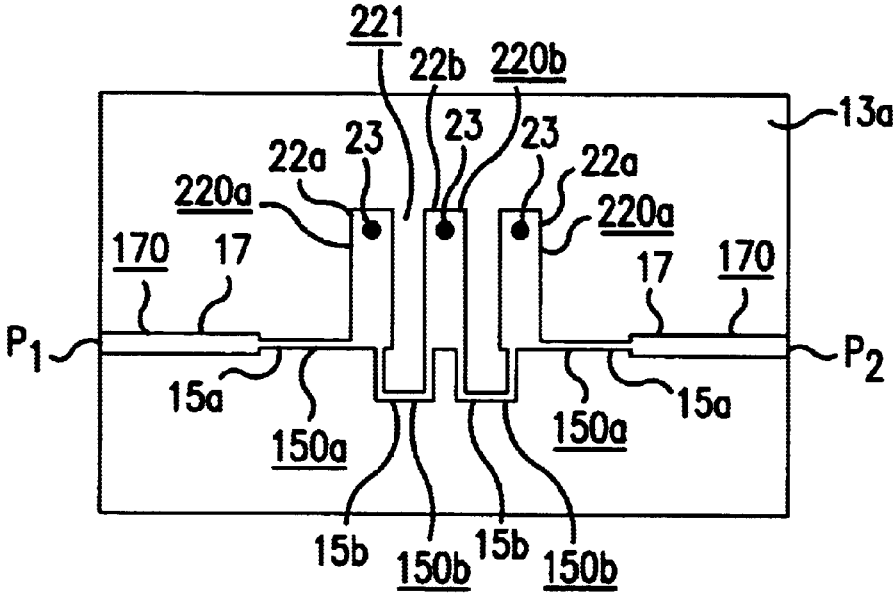
FIGS. 13A and 13B are schematic views illustrating a configuration of a low-pass filter formed of a triplet line in accordance with a sixth embodiment of the present invention.
Figure 13B:
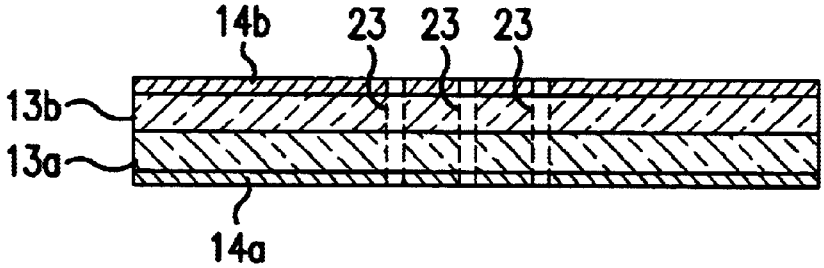

FIGS. 13A and 13B are schematic views illustrating a configuration of a low-pass filter formed of a triplet line in accordance with a sixth embodiment of the present invention. Here, the low-pass filter will be described according to an example in which the low-pass filter in accordance with the fifth embodiment shown in FIG. 9 is formed of a triplet line.

In FIGS. 13A and 13B, reference numerals 13*a* and 13*b* denote dielectric substrates; 14*a* denotes a film-like external conductor that is formed in close adherence to one side of the dielectric substrate 13*a;* 14*b* denotes a film-like external conductor that is formed in close adherence to one side of the dielectric substrate 13*b;* 15*a* denotes narrow strip conductors that are formed in close adherence to the other side of the dielectric substrate 13*a;* 15*b* denotes narrow strip conductors that are formed in close adherence to the other side of the dielectric substrate 13*b;* 22*a* and 22*b* denote one end short-circuit strip conductors that are formed in close adherence to the other side of the dielectric substrate 13*a;* and 17 denotes strip conductors. In addition, reference numeral 23 denotes through-holes that connect one ends of the strip conductors 22*a* and 22*b* to the external conductor 14*a* and the external conductor 14*b,* respectively, to electrically short them.

In addition, reference numeral 150*a* denotes high impedance lines (second high impedance lines) consisting of the dielectric substrates 13*a* and 13*b*, the external conductors 14*a* and 14*b* and the strip conductor 15*a*, 150*b* denotes high impedance lines (first high impedance line) consisting of the dielectric substrates 13*a* and 13*b*, the external conductors 14*a* and 14*b* and the strip conductors 15*b*, 220*a* and 220*b* are top end short-circuit stubs consisting of the dielectric substrates 13*a* and 13*b*, the external conductors 14*a* and 14*b*, each of the strip conductors 22*a* and 22*b* and the through-holes 23, 221 denotes a combined line consisting of the three top end short-circuit stubs 220*a* and 220*b* that are arranged substantially in parallel in such a manner that short-circuit ends face an identical direction, 170 denotes input and output lines consisting of the dielectric substrates 13*a* and 13*b*, the external conductors 14*a* and 14*b* and the strip conductors 17, reference character P1 denotes an input terminal and P2 denotes an output terminal.

The dielectric substrate 13*a* and the dielectric substrate 13*b* are superimposed in such a manner that the side of the dielectric substrate 13*a* on which the strip conductors 15*a*, 15*b*, 22*a*, 22*b* and 17 are formed in close adherence and the side of the dielectric substrate 13*b* on which the external conductor 14*b* is not formed oppose each other. Thus, the high impedance lines 150*a*, the high impedance lines 150*b*, the combined lines 221 and the input and output lines 170 are composed of a triplet line.

Axial lengths of the high impedance lines 150*a* and 150*b* are set sufficiently smaller than a wavelength of a pass frequency. On the other hand, axial lengths of the top end short-circuit stubs 220*a* and 220*b* are set longer than ¼ wavelength and shorter than ½ wavelength. The high impedance lines 150*b* are connected between neighboring ends, respectively, among three ends on the opposite side of each short-circuit end of the combined line 221. The high impedance lines 150*a* are connected to the junction of both the ends of the combined line 221 and the high impedance lines 150*b* at its one end and to the input terminal P1 or the output terminal P2 at the other end.

An equivalent circuit of the low-pass filter shown in FIGS. 13A and 13B is represented by FIG. 12B as in the case of FIG. 9.

As described above, according to this sixth embodiment, a low-pass filter is formed of a triplet line. Thus, since a conductor pattern can be formed on the dielectric substrate 13*a* by photo-etching or the like, an effect is realized in that a small low-pass filter with a high accuracy of dimensions and a stable characteristic can be obtained relatively easily in addition to the effect of the first embodiment.

Seventh Embodiment

Figure 14A:
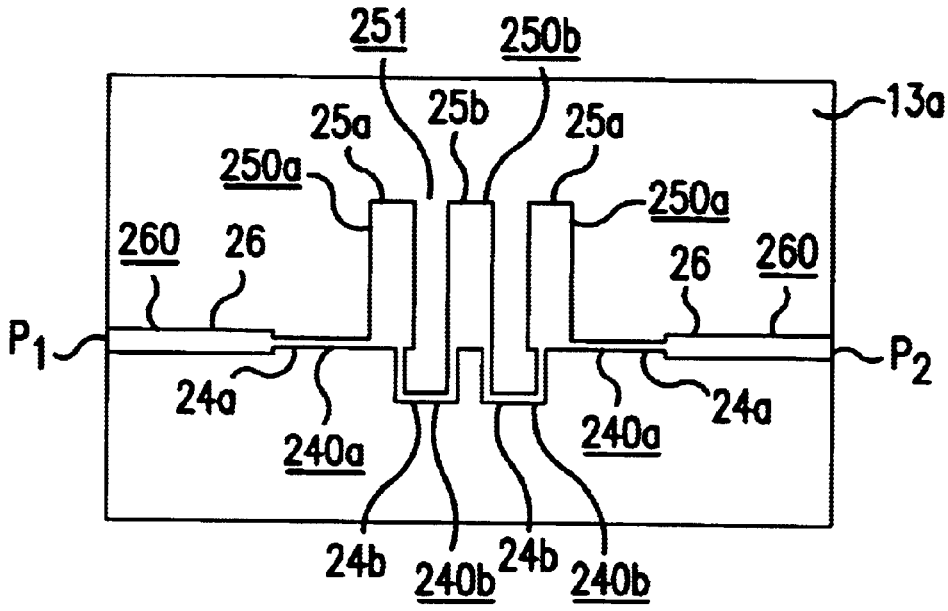
FIGS. 14A and 14B are schematic views illustrating a configuration of a low-pass filter formed of a microstrip line in accordance with a seventh embodiment of the present invention.
Figure 14B:
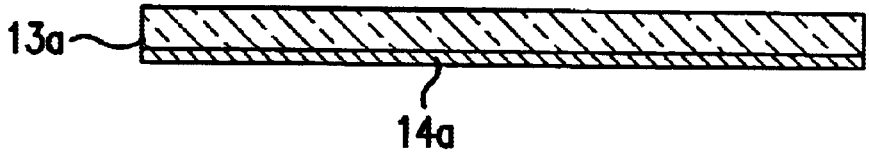

FIGS. 14A and 14B are schematic views illustrating a configuration of a low-pass filter in accordance with a seventh embodiment of the present invention. Here, the low-pass filter will be described according to an example in which the low-pass filter in accordance with the first embodiment shown in FIG. 1 is formed of a micro-strip line. FIG. 14A is a top view showing an arrangement on the dielectric substrate 13*a* as compared with a sectional view shown in FIG. 14B.

In FIGS. 14A and 14B, reference numeral 13*a* denotes a dielectric substrate, 14*a* denotes a film-like external conductor that is formed in close adherence to one side of the dielectric substrate 13*a*, 24*a* and 24*b* denote narrow strip conductors that are formed in close adherence to the other side of the dielectric substrate 13*a*, 25*a* and 25*b* denote one end open strip conductors that are formed in close adherence to the other side of the dielectric substrate 13*a*, and 26 denotes strip conductors.

In addition, reference numeral 240*a* denotes high impedance lines (second high impedance lines) consisting of the dielectric substrate 13*a*, the external conductor 14*a* and the strip conductor 24*a*, 240*b* denotes high impedance lines (first high impedance line) consisting of the dielectric substrate 13*a*, the external conductor 14*a* and the strip conductor 24*b*.

Moreover, reference numerals 250*a* and 250*b* are top end open stubs consisting of the dielectric substrate 13*a*, the external conductor 14*a* and each of the strip conductors 25*a* and 25*b*, 251 denotes a combined line consisting of the three top end open stubs 250*a* and 250*b* that are arranged substantially in parallel in such a manner that open ends face an identical direction, 260 denotes input and output lines consisting of the dielectric substrate 13*a*, the external conductor 14*a* and the strip conductors 26, P1 denotes an input terminal and P2 denotes an output terminal.

Both axial lengths of the high impedance lines 240*a* and 240*b* are set sufficiently smaller than a wavelength of a pass frequency. The high impedance lines 240*b* are connected between neighboring ends, respectively, among three ends on the opposite side of each short-circuit end of the combined line 251. The high impedance lines 240*a* are connected to the junction of the top end open line 260 and the high impedance lines 240*b* at its one end and to the input and output lines 260 at the other end. An equivalent circuit of the low-pass filter shown in FIGS. 14A and 14B is represented by FIG. 4B as in the case of FIG. 1.

As described above, according to this seventh embodiment, a low-pass filter is formed of a micro-strip line. Thus, since a conductor pattern can be formed on the dielectric substrate 13*a* by photo-etching or the like, an effect is realized in that a small low-pass filter with a high accuracy of dimensions and a stable characteristic can be obtained relatively easily in addition to the effect of the first embodiment.

Eighth Embodiment

Figure 15A:
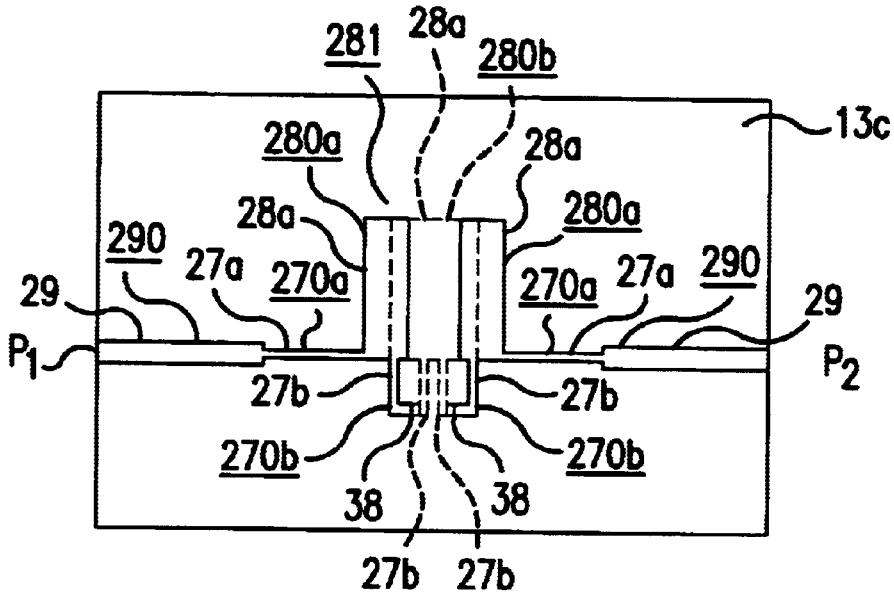
FIGS. 15A and 15B are schematic views illustrating a configuration of a low-pass filter composed of a multi-layer high frequency circuit in accordance with an eighth embodiment of the present invention.
Figure 15B:
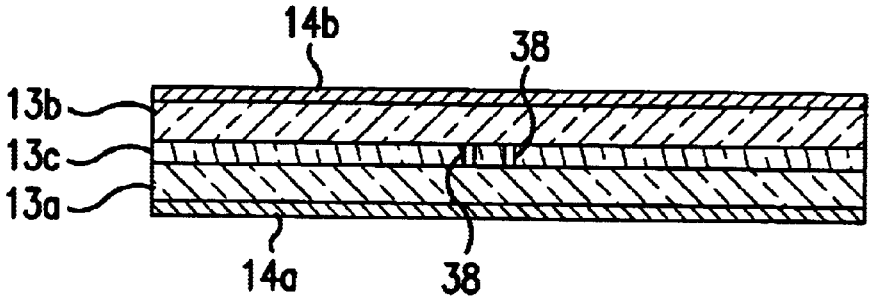

FIGS. 15A and 15B are schematic views illustrating a configuration of a low-pass filter in accordance with an eighth embodiment of the present invention. Here, a low-pass filter is formed of a line having three-layered dielectric substrate in an example in which the low-pass filter in accordance with the first embodiment shown in FIG. 1 is composed of a multi-layer high frequency circuit. FIG. 15A is a top view showing an arrangement on the dielectric substrate 13*c* as compared with a sectional view shown in FIG. 15B.

In FIGS. 15A and 15B, reference numeral 13*c* denotes a dielectric substrate inserted between the dielectric substrate 13*a* and the dielectric substrate 13*b*, 27*a* and 27*b* denote narrow strip conductors that are formed in close adherence to one side (the upper side in FIGS. 15A and 15B) of the dielectric substrate 13*c*, 27*c* denotes a narrow strip conductor that is formed in close adherence to the other side (the lower side in FIGS. 15A and 15B) of the dielectric substrate 13*c*, 28*a* denotes one end open strip conductors that are formed in close adherence to one side (the upper side in FIGS. 15A and 15B) of the dielectric substrate 13*c*), and 28*b* denotes a strip conductor that is formed in close adherence to the other side (the lower side in FIGS. 15A and 15B) of the dielectric substrate 13.

In addition, reference numeral 38 denotes through-holes that connect the two strip conductors 27*b* formed on the upper side of the dielectric substrate 13*c* and the two strip conductors 27*c* formed on the lower side of the dielectric substrate 13*c,* respectively, 270*a* denotes high impedance lines (second high impedance lines) consisting of the dielectric substrates 13*a* to 13*c,* the external conductors 14*a* and 14*b* and the strip conductor 27*a,* and 270*b* denotes high impedance lines (first high impedance lines) consisting of the dielectric substrates 13*a* to 13*c,* the external conductors 14*a* and 14*b,* the strip conductors 27*b* and the strip conductor 27*c* connected by the through-holes 38.

Moreover, reference numeral 280*a* denotes top end open stubs consisting of the dielectric substrates 13*a* to 13*c,* the external conductors 14*a* and 14*b* and the strip conductors 28*a,* 280*b* denotes top end open stubs consisting of the dielectric substrates 13*a* to 13*c,* the external conductors 14*a* and 14*b* and the strip conductor 28*b,* 281 denotes a combined line consisting of the three top end open stubs 280*a* and 280*b* disposed substantially in parallel in such a manner that open ends face an identical direction, 290 denotes input and output lines consisting of the dielectric substrates 13*a* to 13*c,* the external conductors 14*a* and 14*b* and the strip conductor 29.

The low-pass filter in accordance with this eighth embodiment is formed as described above, and the high impedance lines 270*a,* the high impedance lines 270*b,* the combined line 281 and the input and output lines 290 are formed by a triplet line that is in the state in which each strip conductor (internal conductor) is formed in a position shifted vertically by approximately ½ of the thickness of the dielectric substrate 13*c* from the intermediate position of the external conductor 14*a* and the external conductor 14*b* in a cross section of the low-pass filter. Further, both the axial lengths of the high impedance lines 270*a* and the high impedance lines 270*b* are set sufficiently smaller than a wavelength of a pass frequency.

In addition, each of the strip conductors 28*a* and 28*b* of the three top end open stubs 280*a* and 280*b* is disposed in such manner that the wide sides thereof oppose each other via the dielectric substrate 13*c*. The high impedance lines 270*b* are connected between the three ends positioned in the open ends of the opposite side of the combined line 281. The high impedance lines 270*a* are connected to the junction of the top end open stubs 280*a* and the high impedance lines 270*b* at one ends and to the input and output lines 290 at the other ends. An equivalent circuit of the low-pass filter shown in FIGS. 15A and 15B is represented by FIG. 4A as in the case of FIG. 1.

Further, in the configuration shown in FIGS. 15A and 15B, a strip conductor forming a central conductor of a top end open stub and a strip conductor forming a central conductor of a high impedance line are formed on a front side and a back side of a second dielectric layer. However, this configuration can be applied to the case in which a top end short-circuit stub is used instead of a top end open stub.

As described above, according to this eighth embodiment, each of the strip conductors 28*a* and 28*b* of the top end open stubs 280*a* and 280*b* is disposed in such a manner that the wide sides thereof substantially oppose each other via the dielectric substrate 13*c*. Thus, an effect is realized in that a relatively large combined capacitance CP2 is obtained and a steeper out-of band attenuation characteristic is obtained in addition to the effects of the first embodiment and the second embodiment or the seventh embodiment.

Ninth Embodiment

Figure 16A:
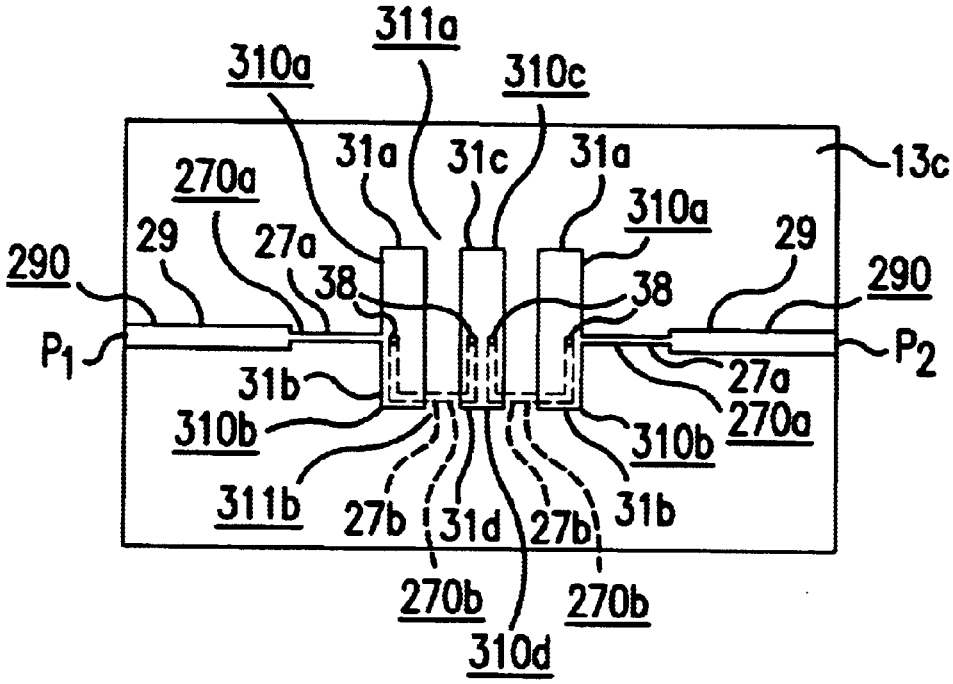
FIGS. 16A and 16B are schematic views illustrating a configuration of a low-pass filter composed of a multi-layer high frequency circuit in accordance with a ninth embodiment of the present invention.
Figure 16B:
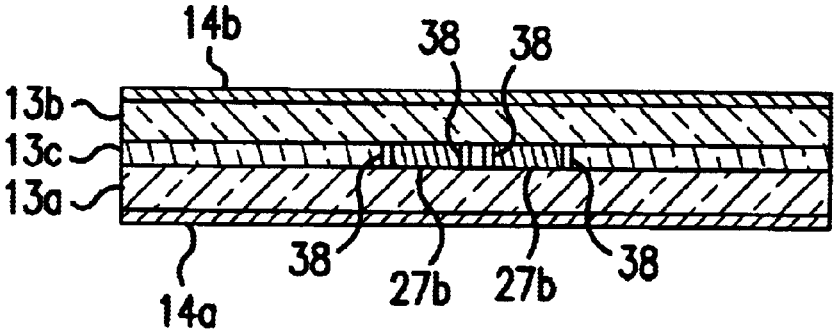

FIGS. 16A and 16B are schematic views illustrating a configuration of a low-pass filter composed in accordance with a ninth embodiment of the present invention. Here, a low-pass filter is formed of a line having three-layered dielectric substrate in another example in which the low-pass filter is composed of a multi-layer high frequency circuit. FIG. 16A is a top view showing an arrangement on the dielectric substrate 13*c* as compared with a sectional view shown in FIG. 16B.

In FIGS. 16A and 16B, reference numeral 13*c* denotes a dielectric substrate inserted between the dielectric substrate 13*a* and the dielectric substrate 13*b,* 27*a* denotes narrow strip conductors that are formed in close adherence to one side (the upper side in FIGS. 16A and 16B) of the dielectric substrate 13*c,* and 27*b* denotes narrow strip conductors that are formed in close adherence to the other side (the lower side in FIGS. 16A and 16B) of the dielectric substrate 13*c*.

In addition, reference numerals 31*a,* 31*b,* 31*c* and 31*d* denote one end open strip conductors that are formed in close adherence to one side (the upper side in FIGS. 16A and 16B) of the dielectric substrate 13*c,* 310*a,* 310*b,* 310*c* and 310*d* denote top end open subs consisting of the dielectric substrates 13*a* to 13*c,* the external conductors 14*a* and 14*b* and the strip conductors 31*a* to 31*d,* respectively, and 311*a* denote a combined line consisting of three top end open stubs 310*a* and 310*c* that are disposed substantially in parallel in such a manner that their open ends face an identical direction.

In addition, reference numeral 311*b* denotes a combine line consisting of the three top end stubs 310*b* and 310*d* that are disposed substantially in parallel in such a manner that their open ends face an identical direction that is opposite to the top end open stubs 310*a* and 310*c* of the combined line 311*a*.

Here, the strip conductors 31*a* and 31*b* and the strip conductors 31*c* and 31*d* have an electric length θ that is smaller than π/2, respectively, and are connected in parallel with each other at the ends on the opposite side of the respective open ends to form integral strip conductors.

In addition, reference numeral 38 denotes through-holes that connect each of the parts between the ends on the opposite side of the open ends, which are connected in parallel, of the strip conductors 31*a* and 31*b* formed on the upper side of the dielectric substrate 13*c* and the ends on the opposite side of the open ends, which are connected in parallel, of the strip conductors 31*c* and 31*d* by the strip conductors 27*b* formed on the lower side of the dielectric substrate 13*c,* respectively.

Further, reference numeral 270*a* denotes high impedance lines (second high impedance lines) consisting of the dielectric substrates 13*a* to 13*c,* the external conductors 14*a* and 14*b* and the strip conductors 27*a,* 270*b* denotes high impedance lines (first high impedance lines) consisting of the dielectric substrates 13*a* to 13*c,* the external conductors 14*a* and 14*b* and the strip conductors 27*b,* 290 denotes input and output lines consisting of the dielectric substrates 13*a* to 13*c,* the external conductors 14*a* and 14*b* and the strip conductors 29.

The low-pass filter in accordance with this ninth embodiment is formed as described above, and the high impedance lines 270*a,* the high impedance lines 270*b,* the combined lines 311*a* and 311*b* and the input and output lines 290 are formed by a triplet line that is in the state in which each strip conductor (internal conductor) is formed in a position shifted vertically by approximately ½ of the thickness of the dielectric substrate 13*c* from the intermediate position of the external conductor 14*a* and the external conductor 14*b* in a cross section of the low-pass filter. Further, both the axial lengths of the high impedance lines 270*a* and the high impedance lines 270*b* are set sufficiently smaller than a wavelength of a pass frequency.

As described above, the high impedance lines 270*b* are connected to the parts between the three common ends on the opposite side of the open ends of the combined line 311*a* and the combined line 311*b*. The high impedance lines 270*a* are connected to the common ends on the opposite side of the open ends of the top end open stubs 310*a* and the top end open stubs 310*b* at one ends and to the input and output lines 290 at the other end.

Although an equivalent circuit of the low-pass filter shown in FIGS. 16A and 16B is similar to FIG. 4B, parameters of the capacitor Cp2 and the capacitors C2 and C3 are increased to parameters of the two combined lines 311*a* and 311*b*.

As described above, according to this ninth embodiment, parameters of the capacitor Cp2 and the capacitors C2 and C3 can be increased to parameters of the two combined lines 311*a* and 311*b*. Thus, an effect is realized in that a degree of freedom of design can be increased in addition to the effects of the first embodiment and the second embodiment or the seventh embodiment.

Tenth Embodiment

Figure 17A:
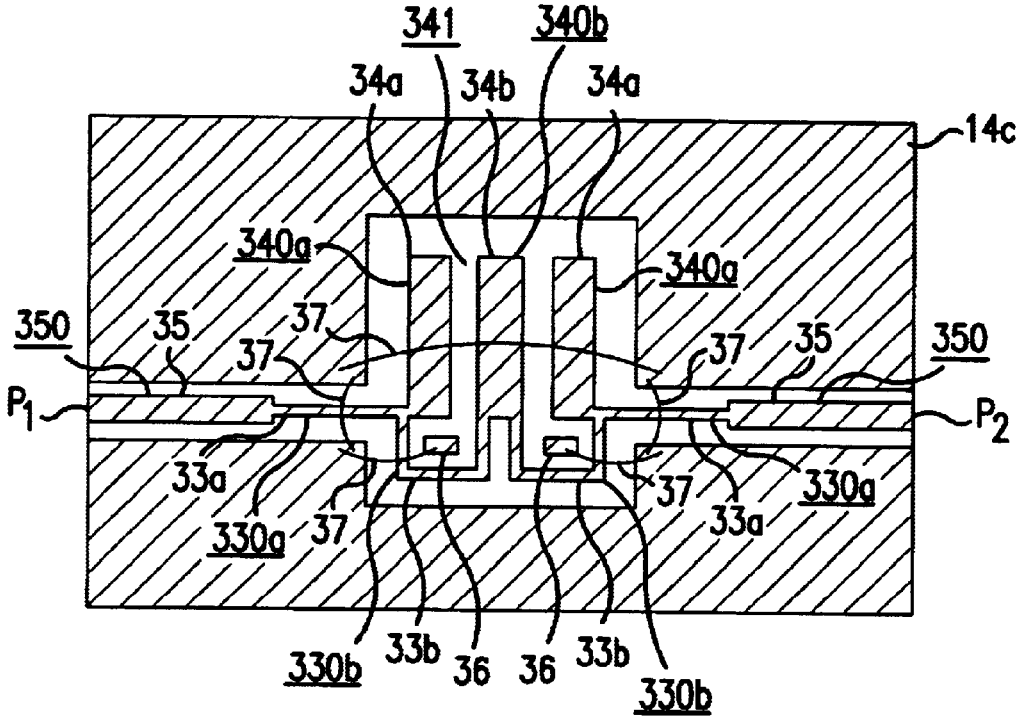
FIGS. 17A and 17B are schematic views illustrating a configuration of a low-pass filter formed of a coplanar line in accordance with a tenth embodiment of the present invention.
Figure 17B:
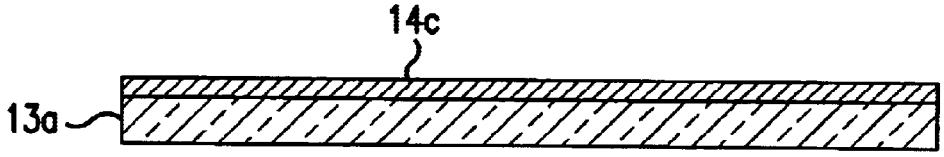

FIGS. 17A and 17B are schematic views illustrating a configuration of a low-pass filter in accordance with a tenth embodiment of the present invention. Here, the low-pass filter in accordance with the first embodiment shown in FIG. 1 is described according to another example in which the low-pass filter is composed of a coplanar line. FIG. 17A is a top view showing an arrangement on a ground conductor 14*c* as compared with a sectional view shown in FIG. 17B.

In FIGS. 17A and 17B, reference numeral 13*a* denotes a dielectric substrate, 14*c* denotes a ground conductor for forming a coplanar line that is formed in close adherence to one side (the upper side in FIGS. 17A and 17B) of the dielectric substrate 13*a*, 33*a* and 33*b* denote narrow strip conductors that are formed in close adherence on the upper side of the dielectric substrate 13*a*, 34*a* and 34*b* denote one end open strip conductors that are formed in close adherence to the upper side of the dielectric substrate 13*a*, and 35 denotes strip conductors that are formed in close adherence to the upper side of the dielectric substrate 13*a*.

In addition, reference numeral 36 denotes conductor pads that are formed in close adherence to the upper side of the dielectric substrate 13*a*, 37 denotes conductor wires that connect each part of the ground conductor 14 and the conductor pads 36 in order to maintain the ground conductor on the upper side of the dielectric substrate 13*a* at the same potential, 330*a* denotes high impedance lines (second high impedance lines) consisting of the dielectric substrate 13*a*, the ground conductor 14*c* and the strip conductors 33*a*, 330*b* denotes high impedance lines (first high impedance lines) consisting of the dielectric substrate 13*a*, the ground conductor 14*c* or the like (including the conductor pads 36) and the strip conductors 33*b*.

Moreover, reference numerals 340*a* and 340*b* denote top end open stubs consisting of the dielectric substrate 13*a*, the ground conductor 14*c* or the like and the strip conductors 34*a* and 34*b*, 341 denotes a combined line consisting of the three top end open stubs 340*a* and 340*b* that are disposed substantially in parallel in such a manner that their open ends face an identical direction, and 350 denotes input and output lines consisting of the dielectric substrate 13*a*, the ground conductor 14*c* and the strip conductors 35.

Both axial lengths of the high impedance lines 330*a* and the high impedance lines 330*b* are set sufficiently smaller than a wavelength of a pass frequency. The high impedance lines 330*b* are connected between adjacent ends, respectively, among three ends on the opposite side of opening ends of the combined line 341. Each of the high impedance lines 330*a* are connected to the junction of both the ends of the combined line 341 and the high impedance lines 330*b* at its one end and to the input and output lines 350 at the other end. An equivalent circuit of the low-pass filter shown in FIGS. 17A and 17B is represented by FIG. 4B as in the case of FIG. 1.

As described above, according to this tenth embodiment, a low-pass filter is formed of a coplanar line. Thus, since a conductor pattern can be formed on the dielectric substrate 13*a* by photo-etching or the like, an effect is realized in that a small low-pass filter with a high accuracy of dimensions and a stable characteristic can be obtained relatively easily in addition to the effect of the first embodiment.

In addition, since a low-pass filter is formed of a coplanar line, an effect is realized in that a circuit of a low-pass filter can be formed only on one surface of the dielectric substrate 13*a*.

As described above, according to the low-pass filter of the present invention, there are provided a combined line that is formed of three or more top end open stubs that are set such that an electric length thereof is made large in a range in which the length is shorter than ¼ of a wavelength of a pass frequency and are disposed substantially in parallel in such a manner that an open end of each of the three or more top end open stubs faces an identical direction and a high impedance line that is connected to at least one part among parts between neighboring ends in the opposite side of the open ends of the top end open stubs and has a length shorter than a wavelength of a pass frequency. Thus, a combined line is formed using three or more top end open stubs, whereby a number of stages of a filter element that becomes an element of a low-pass filter can be increased compared with the conventional art, and a length of the top end stubs can be set large, whereby a required capacitance can be made larger compared with the conventional art. Therefore, there is an effect in that a low-pass filter having a steep out-of band attenuation characteristic that is capable of setting a frequency of an attenuation pole as low as in the vicinity of a pass band is obtained.

In addition, according to the low-pass filter of the present invention, there are provided a combined line that is formed of three or more top end open stubs that are set such that an electric length thereof is made large in a range in which the length is shorter than ¼ of a wavelength of a pass frequency and are disposed substantially in parallel in such a manner that an open end of each of the three or more top end open stubs faces an identical direction, a first high impedance line that is connected to at least one part among parts between neighboring ends in the opposite side of the open ends of the top end open stubs and has a length shorter than a wavelength of a pass frequency, and at least one second high impedance line that is connected at one end to the ends on the opposite side of the open ends of the top end open stubs among the both ends of the three or more top end open stubs and has a length shorter than a wavelength of a pass frequency. Thus, there is an effect in that a low-pass filter having a steeper out-of band attenuation characteristic can be obtained by inductance of the second high impedance line.

In addition, according to the low-pass filter of the present invention, there are provided a combined line that is formed of three or more top end open stubs that are set such that an electric length thereof is made large in a range in which the length is shorter than ¼ of a wavelength of a pass frequency and are disposed substantially in parallel in such a manner that an open end of each of the three or more top end open stubs faces an identical direction, a first high impedance line that is connected to at least one part among parts between neighboring ends in the opposite side of the open ends of the top end open stubs and has a length shorter than a wavelength of a pass frequency, at least one second high impedance line that is connected at one end to the ends on the opposite side of the open ends of the top end open stubs among the both ends of the three or more top end open stubs and has a length shorter than a wavelength of a pass frequency, and a low impedance line that is connected at one end to at least the one other end of the second high impedance line and has a length shorter than a wavelength of a pass frequency. Thus, there is an effect in that the number stages of a filter element that becomes an element of a low-pass filter can be increased by capacitance of the low impedance line and a low-pass filter having a steeper out-of band attenuation characteristic can be obtained.

In addition, according to the low-pass filter of the present invention, a plurality of the low-pass filters according to claim 1, 2, or 3 of the present invention are cascaded by inserting at least one second high impedance line, which has a length shorter than a wavelength of a pass frequency, in series between combined lines of the low-pass filter that are connected one after another to form a multi-stage filter. Thus, there is an effect in that a low-pass filter having a steeper out-of band attenuation characteristic is obtained.

Moreover, according to the low-pass filter of the present invention, there are provided a combined line that is formed of three or more top end short-circuit stubs that are set such that an electric length thereof is made large in a range in which the length is longer than ¼ and shorter than ½ of a wavelength of a pass frequency and disposed substantially in parallel in such a manner that an open end of each of the three or more top end open stubs faces an identical direction, and a high impedance line that is connected to at least one part among parts between neighboring ends in the opposite side of the short-circuit ends of the top end short-circuit stubs and has a length shorter than a wavelength of a pass frequency. Thus, there is an effect in that a low-pass filter can be obtained relatively easily in which the number of stages of a filter element that becomes an element of a low-pass filter can be increased as compared with the conventional art by forming a combined line by three or more top end short-circuit stubs, and a required capacitance can be made larger compared with the conventional art by setting the length of the low-pass filter large, thereby achieving a steep out-of band attenuation characteristic capable of setting a frequency of an attenuation pole as low as the in vicinity of a pass band.

In addition, according to the low-pass filter of the present invention, since the low-pass filter has a simple configuration of a plane circuit formed of a triplet line, there is an effect in that a small low-pass filter with a high accuracy of dimensions and a stable characteristic can be obtained relatively easily.

In addition, according to the low-pass filter of the present invention, since the low-pass filter has a simple configuration of a plane circuit formed of a micro-strip line, there is an effect in that a small low-pass filter with a high accuracy of dimensions and a stable characteristic can be obtained relatively easily.

In addition, according to the low-pass filter of the present invention, since the low-pass filter has a simple configuration of a plane circuit formed of a coplanar line, there is an effect in that a small low-pass filter with a high accuracy of dimensions and a stable characteristic can be obtained relatively easily. Moreover, an effect is realized in that a circuit of a low-pass filter can be formed only on one surface of a dielectric substrate.

In addition, according to the low-pass filter of the present invention, the low-pass filter has a first conductor layer, a second conductor layer and a third conductor layer, which are disposed with the second conductor layer being sandwiched between the first and the third layers, and a ground conductor formed on external surfaces of the first and the third conductor layers, and is composed of a multi-layer high frequency circuit in which a central conductor is formed on the front and the back of the second conductor layer, and has a strip conductor forming a central conductor of a top end open stub and a strip conductor forming a central conductor of a high impedance line that are formed separately on the front side and the back side of the second conductor layer. Thus, there is an effect in that a degree of freedom regarding a configuration of a plane circuit can be increased and a small low-pass filter with a high accuracy of dimensions and a stable characteristic can be obtained relatively easily.

In addition, according to the low-pass filter of the present invention, the low-pass filter has a first conductor layer, a second conductor layer and a third conductor layer, which are disposed with the second conductor layer being sandwiched between the first and the third layers, and a ground conductor formed on external surfaces of the first and the third conductor layers, and is composed of a multi-layer high frequency circuit in which a central conductor is formed in the front and the back of the second conductor layer, has each strip conductor forming a central conductor of three or more top end open stubs forming a combined line, to which a high impedance line that is shorter than the wavelength of the pass frequency is connected between ends on the opposite side of the open ends of the top end open stubs adjacent with each other, provided on the front and the back of the second dielectric layer with sides opposing each other, and each strip conductor forming a central conductor of the high impedance line is connected to each strip conductor of the top end open stubs to be provided on the front and the back of the second dielectric conductor layer and connected via a through-hole in the middle. Thus, there is an effect in that a low-pass filter can be obtained which can make a combined capacitance larger and set an attenuation pole frequency as low as the vicinity of a pass frequency and has a steeper out-of band attenuation characteristic.

In addition, according to the low-pass filter of the present invention, each of strip conductors that are composed of a multi-layer high frequency circuit, which is provided with a pair of combined lines formed by three or more top end open stubs that are set to have a larger electric length in a range in which the length is shorter than ¼ a wavelength of a pass frequency and disposed substantially in parallel in such a manner that each open end of the three or more top end open stubs faces an identical direction, and are connected in parallel such that the ends on the opposite side of the open ends of the top end open stubs in each of the pair of combined lines are opposed to each other to be connected, and the low-pass filter is provided with a high impedance line that is connected to at least one part between neighboring ends on the opposite side of the open ends of the top end open stubs and is shorter than a wavelength of a pass frequency, has a first conductor layer, a second conductor layer and a third conductor layer disposed with the second conductor layer being sandwiched between the first and the third conductor layers, ground conductors formed on the external surfaces of the first and the third conductor layers, and is composed of a multi-layer high frequency circuit in which a central conductor is formed on the front and the back side of the second dielectric layer, and has each strip conductor forming a central conductor of the top end open stubs formed on one side of the second dielectric conductor layer, and a strip conductor forming a central conductor of the high impedance line formed on the other side of the second dielectric layer, and in which the connection between ends on the opposite side of the open ends of the top end open stubs and the high impedance line is made by the connection via a through-hole of a strip conductor forming a central conductor formed on the front and the back side of the second dielectric layer. Thus, since a parameter of a combined capacitance is increased to a parameter of a pair of cascaded combined lines, there is an effect in that a low-pass filter capable of increasing a degree of freedom of design is obtained.

INDUSTRIAL APPLICABILITY

As described above, according to the present invention, a low-pass filter that can set an attenuation pole in the vicinity of a pass band and has a steep out-of band attenuation characteristic can be obtained even if it has a simple configuration of a plane circuit such as a triplet line or a micro-strip line.

What is claimed is:

1. A low-pass filter comprising:

at least two or more top end open stubs each having an open end and a closed end, which have an electric length less than ¼ of a wavelength of a passband frequency and wherein said top end open stubs are disposed substantially in parallel in such a manner that said open end of each of said two or more top end open stubs are directed in an identical direction; and a high impedance line connected to at least one of said closed ends of said top end open stubs wherein a length of said high impedance line is set to be less than the wavelength of the passband frequency, wherein said closed end is at an opposite end of said open end of said top end open stubs, and wherein said open end is not electrically connected.

2. A low-pass filter according to claim 1, wherein said high impedance line is a first high impedance line, and the low-pass filter further comprises, in addition to said first high impedance line, at least one second high impedance line that is connected at a first end to one of said closed ends of said top end open stubs and has a length less than the wavelength of the passband frequency.

3. A low-pass filter according to claim 2, further comprising a low impedance line that is connected to a second end of said second high impedance line and has a length less than the wavelength of the passband frequency.

4. A multi-stage filter formed by cascading low-pass filters in a plurality of stages each of said low pass filters, comprising:

at least two or more top end open stubs each having an open end and a closed end, which have an electric length less than ¼ of a wavelength of a passband frequency and wherein said top end open stubs are disposed substantially in parallel in such a manner that said open end of each of said two or more top end open stubs are directed in an identical direction; and a high impedance line connected to at least one of said closed ends of said top end open stubs wherein a length of said high impedance line is set to be less than the wavelength of the passband frequency, wherein said low pass filters are operatively connected to one another via said high impedance line, wherein said closed end is at an opposite end of said open end of said top end open stubs, and wherein said open end is not electrically connected.

5. A low-pass filter according to claim 1, wherein the low-pass filter is formed of a triplet line.

6. A low-pass filter according to claim 1, wherein the low-pass filter is formed of a micro-strip line.

7. A low-pass filter according to claim 1, wherein the low-pass filter is formed of a coplanar line.

8. A low-pass filter comprising:

at least two or more top end short-circuit stubs each having a short-circuit end and a closed end, which have an electric length greater than ¼ and less than ½ of a wavelength of a passband frequency, and wherein said top end short-circuit stubs are disposed substantially in parallel in such a manner that each of said short-circuit ends of said two or more top end short-circuit stubs are directed in an identical direction; and a high impedance line connected to at least one of said closed ends of said top end short-circuit stubs and has a length that is less than the wavelength of the passband frequency, wherein said closed end is at an opposite end of said open end of said top end open stubs.

9. A low-pass filter according to claim 8, wherein the low-pass filter is formed of a triplet line.

10. A low-pass filter according to claim 8, wherein the low-pass filter is formed of a micro-strip line.

11. A low-pass filter according to claim 8, wherein the low-pass filter is formed of a coplanar line.

12. A low-pass filter according to claim 1, wherein the low-pass filter has a first conductor layer, a second conductor layer and a third conductor layer, which are disposed with said second conductor layer being sandwiched between said first and said third conductor layers, and a ground conductor formed on external surfaces of said first and said third conductor layers, and is composed of a multi-layer high frequency circuit in which a central conductor is formed on the front and the back of said second conductor layer, and has a first strip conductor forming a first central conductor of at least one of said top end open stubs and a second strip conductor forming a second central conductor of said high impedance line that are formed separately on the front side and the back side of said second conductor layer.

13. A low-pass filter according to claim 8, wherein the low-pass filter has a first conductor layer, a second conductor layer and a third conductor layer, which are disposed with said second conductor layer being sandwiched between said first and said third conductor layers, and a ground conductor formed on external surfaces of said first and said third conductor layers, and is composed of a multi-layer high frequency circuit in which a central conductor is formed on the front and the back of said second conductor layer, and has a first strip conductor forming a first central conductor of at least one said top end short-circuit stubs and a second strip conductor forming a second central conductor of said high impedance line that are formed separately on the front side and the back side of said second conductor layer.

14. A low-pass filter according to claim 1, wherein the low-pass filter has a first conductor layer, a second conductor layer and a third conductor layer, which are disposed with said second conductor layer being sandwiched between said first and said third conductor layers, and a ground conductor formed on external surfaces of said first and said third conductor layers, and is composed of a multi-layer high frequency circuit in which a central conductor is formed in the front and the back of said second conductor layer, and has a strip conductor forming a first central conductor of said at least two top end open stubs which form a combined line, to which said high impedance line is connected to and is provided on the front and the back of said second conductor layer with sides opposing each other, and each strip conductor forming a second central conductor of said high impedance line and is connected to each strip conductor of said top end open stubs and is provided on the front and the back of said second conductor layer and connected via a through-hole in the middle.

15. A low-pass filter comprising: combined lines formed of at least two or more top end open stubs, having an open end and a closed end, wherein a pair of combined lines are disposed substantially in parallel in such a manner that each open end of said two or more top end open stubs faces an identical direction, and are connected in parallel such that the closed ends in each pair of combined lines are opposed to each other and the low-pass filter is provided with a high impedance line which is connected to at least one closed end of said top end open stubs and has an electric length that is less than a wavelength of a passband frequency, and has a first conductor layer, a second conductor layer and a third conductor layer disposed with said second conductor layer being sandwiched between said first and third conductor layers and ground conductors formed on the external surfaces of said first and third conductor layers, and is composed of a multi-layer high frequency circuit in which a central conductor is formed on a front and a back side of said second dielectric layer, and has a first strip conductor forming a first central conductor of said top end open stubs which is formed on a first side of said second conductor layer, and a second strip conductor forming a second central conductor of said high impedance line which is formed on a second side of said second conductor layer, and wherein the connection between said closed ends and said high impedance line is made by the connection via a through-hole of a strip conductor forming a central conductor formed on the front and the back side of said second conductor layer, wherein said closed end is at an opposite end of said open end of said top end open stubs.

* * * * *